US011525232B2

(12) United States Patent
Kaufman et al.

(10) Patent No.: US 11,525,232 B2
(45) **Date of Patent: *Dec. 13, 2022**

(54) MODULAR FOUNDATION SUPPORT SYSTEMS AND METHODS INCLUDING SHAFTS WITH INTERLOCKING TORQUE TRANSMITTING COUPLINGS

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/071,337

(22) Filed: Oct. 15, 2020

(65) Prior Publication Data

US 2021/0071381 A1 Mar. 11, 2021

Related U.S. Application Data

(63) Continuation of application No. 16/229,514, filed on Dec. 21, 2018, now Pat. No. 10,844,569, which is a (Continued)

(51) Int. Cl.
*E02D 5/52* (2006.01)
*E02D 35/00* (2006.01)
(Continued)

(52) U.S. Cl.
CPC ..... *E02D 5/526* (2013.01); *E02D 5/24* (2013.01); *E02D 5/56* (2013.01); *E02D 7/22* (2013.01); *E02D 27/12* (2013.01); *E02D 27/48* (2013.01); *E02D 35/005* (2013.01); *E04G 23/065* (2013.01); *E21B 17/04* (2013.01); *E21B 17/046* (2013.01); *E02D 5/28* (2013.01);
(Continued)

(58) Field of Classification Search
CPC ..... E02D 5/523; E02D 5/526; E02D 35/00; E02D 35/005; E02D 5/24; E02D 5/56; E02D 5/28; E02D 7/22; E02D 27/12; E02D 27/48; E21B 17/02; E21B 17/04; E21B 17/046; E04G 23/065; E04G 23/04; Y10T 403/7033; Y10T 403/7035
See application file for complete search history.

(56) References Cited

U.S. PATENT DOCUMENTS 1,469,304 A 10/1923 Hughes
2,141,880 A 12/1938 Satre
(Continued)

FOREIGN PATENT DOCUMENTS

AU 2013204548 A1 5/2013
JP H1121882 A 1/1999
(Continued)

OTHER PUBLICATIONS

International Search Report and Written Opinion of International Application No. PCT/US2016/31783, dated Jun. 16, 2016, 11 pages.

*Primary Examiner* — Frederick L Lagman
(74) *Attorney, Agent, or Firm* — Armstrong Teasdale LLP

(57) ABSTRACT

A modular foundation support system includes modular foundation support components including self-aligning and torque transmitting coupler features wherein a plurality of axially elongated ribs are aligned with a plurality of axially elongated ribs to rotationally interlocke the modular foundation support components to one another.

29 Claims, 20 Drawing Sheets

Related U.S. Application Data continuation-in-part of application No. 15/833,701, filed on Dec. 6, 2017, now Pat. No. 10,294,623, which is a continuation of application No. 15/331,189, filed on Oct. 21, 2016, now Pat. No. 9,863,114, which is a continuation of application No. 14/708,384, filed on May 11, 2015, now Pat. No. 9,506,214.

(51) Int. Cl.

| | |
|---|---|
| ***E02D 27/12*** | (2006.01) |
| ***E02D 27/48*** | (2006.01) |
| ***E21B 17/046*** | (2006.01) |
| ***E02D 7/22*** | (2006.01) |
| ***E21B 17/04*** | (2006.01) |
| ***E04G 23/06*** | (2006.01) |
| ***E02D 5/56*** | (2006.01) |
| ***E02D 5/24*** | (2006.01) |
| *E04G 23/04* | (2006.01) |
| *E02D 5/28* | (2006.01) |

(52) U.S. Cl.

CPC ..... *E04G 23/04* (2013.01); *Y10T 403/7033* (2015.01); *Y10T 403/7035* (2015.01)

(56) References Cited

U.S. PATENT DOCUMENTS

| | | | |
|---|---|---|---|
| 2,708,828 | A | 5/1955 | Pruyn |
| 2,819,879 | A | 1/1958 | Beck |
| 2,890,900 | A | 6/1959 | Williamson, Jr. et al. |
| 3,119,635 | A | 1/1964 | Dealy et al. |
| 3,637,238 | A | 1/1972 | Grosch |
| 3,948,545 | A | 4/1976 | Bonds |
| 3,953,981 | A | 5/1976 | Axelsson et al. |
| 4,668,119 | A | 5/1987 | Galletti |
| 4,790,571 | A | 12/1988 | Montanari et al. |
| 5,050,691 | A | 9/1991 | Moses |
| 5,707,180 | A | 1/1998 | Vickars et al. |
| 5,829,524 | A | 11/1998 | Flanders et al. |
| 5,950,744 | A | 9/1999 | Hughes |
| 6,168,213 | B1 | 1/2001 | Muller |
| 6,183,167 | B1 | 2/2001 | Ruiz et al. |
| 6,352,391 | B1 | 3/2002 | Jones |
| 6,409,221 | B1 | 6/2002 | Robinson et al. |
| 6,468,003 | B2 | 10/2002 | Merjan et al. |
| 6,551,030 | B1 | 4/2003 | Curry |
| 6,682,267 | B1 | 1/2004 | Jones |
| 6,814,525 | B1 | 11/2004 | Whitsett |
| 6,817,810 | B2 | 11/2004 | Jones |
| 7,037,045 | B2 | 5/2006 | Jones |
| 7,073,980 | B2 | 7/2006 | Merjan et al. |
| 7,220,081 | B1 | 5/2007 | Gantt, Jr. |
| 7,226,090 | B2 | 6/2007 | Hughes |
| 7,314,335 | B2 | 1/2008 | Whitsett |
| 7,354,224 | B2 | 4/2008 | Cinquano |
| 7,390,032 | B2 | 6/2008 | Hughes |
| 7,416,367 | B2 | 8/2008 | St. Onge et al. |
| 7,736,095 | B2 | 6/2010 | Fujita |
| 7,744,316 | B2 | 6/2010 | Kaufman |
| 7,854,451 | B2 | 12/2010 | Davis et al. |
| 7,914,236 | B2 | 3/2011 | Neville |
| 8,298,633 | B1 | 10/2012 | Chen |
| 8,336,937 | B2 | 12/2012 | Farrow |
| 8,458,984 | B2 | 6/2013 | Marshall |
| 8,506,206 | B2 | 8/2013 | Desmeules |
| 8,517,640 | B2 | 8/2013 | Kasprick et al. |
| 8,611,621 | B2 | 12/2013 | Drozdzal et al. |
| 8,662,794 | B2 | 3/2014 | Atchley et al. |
| 8,771,520 | B2 | 7/2014 | Lange et al. |
| 8,777,520 | B2 | 7/2014 | Lin |
| 8,888,413 | B2 | 11/2014 | Seider et al. |
| 8,926,228 | B2 | 1/2015 | Stroyer |
| 9,127,513 | B2 | 9/2015 | Matthias |
| 9,133,968 | B2 | 9/2015 | Elrick et al. |
| 9,366,084 | B2 | 6/2016 | Queen et al. |
| 9,453,318 | B2 | 9/2016 | Kemp et al. |
| 9,506,214 | B1 | 11/2016 | Kaufman et al. |
| 9,512,589 | B1 | 12/2016 | Van Polen et al. |
| 9,863,114 | B2 | 1/2018 | Kaufman et al. |
| 10,294,623 | B2 | 5/2019 | Kaufman et al. |
| 10,844,569 | B2 * | 11/2020 | Kaufman ..... E02D 7/22 |
| 2003/0075923 | A1 | 4/2003 | Lepoutre |
| 2004/0047693 | A1 | 3/2004 | Nishiwaki et al. |
| 2004/0076479 | A1 | 4/2004 | Camilleri |
| 2007/0045007 | A1 | 3/2007 | Tjader |
| 2010/0143048 | A1 | 6/2010 | Lin |
| 2011/0180273 | A1 | 7/2011 | Hughes et al. |
| 2011/0188928 | A1 | 8/2011 | West et al. |
| 2014/0196955 | A1 | 7/2014 | Queen et al. |
| 2015/0021530 | A1 | 1/2015 | Gregory et al. |
| 2016/0186402 | A1 | 6/2016 | Tomchesson et al. |
| 2016/0215470 | A1 | 7/2016 | Reusing et al. |
| 2016/0230364 | A1 | 8/2016 | Stroyer |
| 2016/0230478 | A1 | 8/2016 | Dietz |
| 2016/0281432 | A1 | 9/2016 | Queen et al. |

FOREIGN PATENT DOCUMENTS

| | | |
|---|---|---|
| JP | 2003090035 A | 3/2003 |
| JP | 201132783 | 2/2011 |
| JP | 2011247056 A | 12/2011 |

* cited by examiner

MODULAR FOUNDATION SUPPORT SYSTEMS AND METHODS INCLUDING SHAFTS WITH INTERLOCKING TORQUE TRANSMITTING COUPLINGS

CROSS REFERENCE TO RELATED APPLICATIONS

The present application is a continuation application of U.S. patent application Ser. No. 16/229,514 filed Dec. 21, 2018 and now issued U.S. Pat. No. 10,844,569, which is continuation-in-part application of U.S. patent application Ser. No. 15/833,701 filed Dec. 6, 2017 and now issued U.S. Pat. No. 10,294,623, which is a continuation application of U.S. patent application Ser. No. 15/331,189 filed Oct. 21, 2017 and now issued U.S. Pat. No. 9,863,114, which is a continuation application of U.S. patent application Ser. No. 14/708,384 filed May 11, 2015 and now issued U.S. Pat. No. 9,506,214, the complete disclosures of which are hereby incorporated by reference in their entirety.

BACKGROUND OF THE INVENTION

The present invention relates generally to foundation support systems including assemblies of structural support elements, and more specifically to interlocking, self-aligning and torque transmitting couplers for connecting modular foundation elements in building structure foundation support systems and related methods for assembling and installing modular foundation support systems.

Foundation support stability issues are of concern in both new building construction and in maintenance of existing buildings. While much attention is typically paid to the fabrication of a foundation in new construction to adequately support a building structure, on occasion foundation support systems are desired to accomplish the desired stability and prevent the foundation from moving in a way that may negatively affect the structure. As buildings age and settle there is sometimes a shifting of the foundation that can cause damage to the building structure, presenting a need for lifting or jacking the foundation to restore it to a level position where repairs to the structure can be made and further damage to the building structure is prevented. Numerous foundation support systems and methods exist that may capably provide the desired foundation stability and/or may capably lift building foundations to another elevation where they may be optimally supported. Existing foundation support systems and methods typically include a pier or piling driven into the ground proximate a building foundation, leaving a piling projecting upwards on which a support element or lifting element may be attached.

Existing foundation support systems and methods are, however, disadvantaged in some aspects. For example, it is sometimes necessary to extend the length of a piling by connecting an extension piece when conditions are such that a pier is driven deeply into the ground to provide the desired amount of support. Attaching the piling to an extension piece in some existing support systems involves a coupler having fastener holes that is attachable to both the piling and the extension piece.

Because the extension pieces may be many feet long and tend to be relatively heavy it is often quite difficult to complete the desired connections with the proper alignment of the fastener holes in the coupler and the fastener holes in the extension piece so that the connection can be completed by installing a fastener through the aligned holes. If the connections are not properly aligned to make the connection, the integrity of the support system to provide the proper level of support can be compromised and system reliability issues can be presented. Accordingly, the needs of the marketplace have not been completely met with existing building foundation support systems.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

FIG. 4 illustrates a side view of the inner coupler shown in

FIG. 3.

FIG. 23 illustrates a top view of the outer coupler shown in

FIG. 20.

FIG. 29 is a bottom view of the drive tool coupler shown in

FIG. 27.

DETAILED DESCRIPTION OF THE INVENTION

Figure 1:
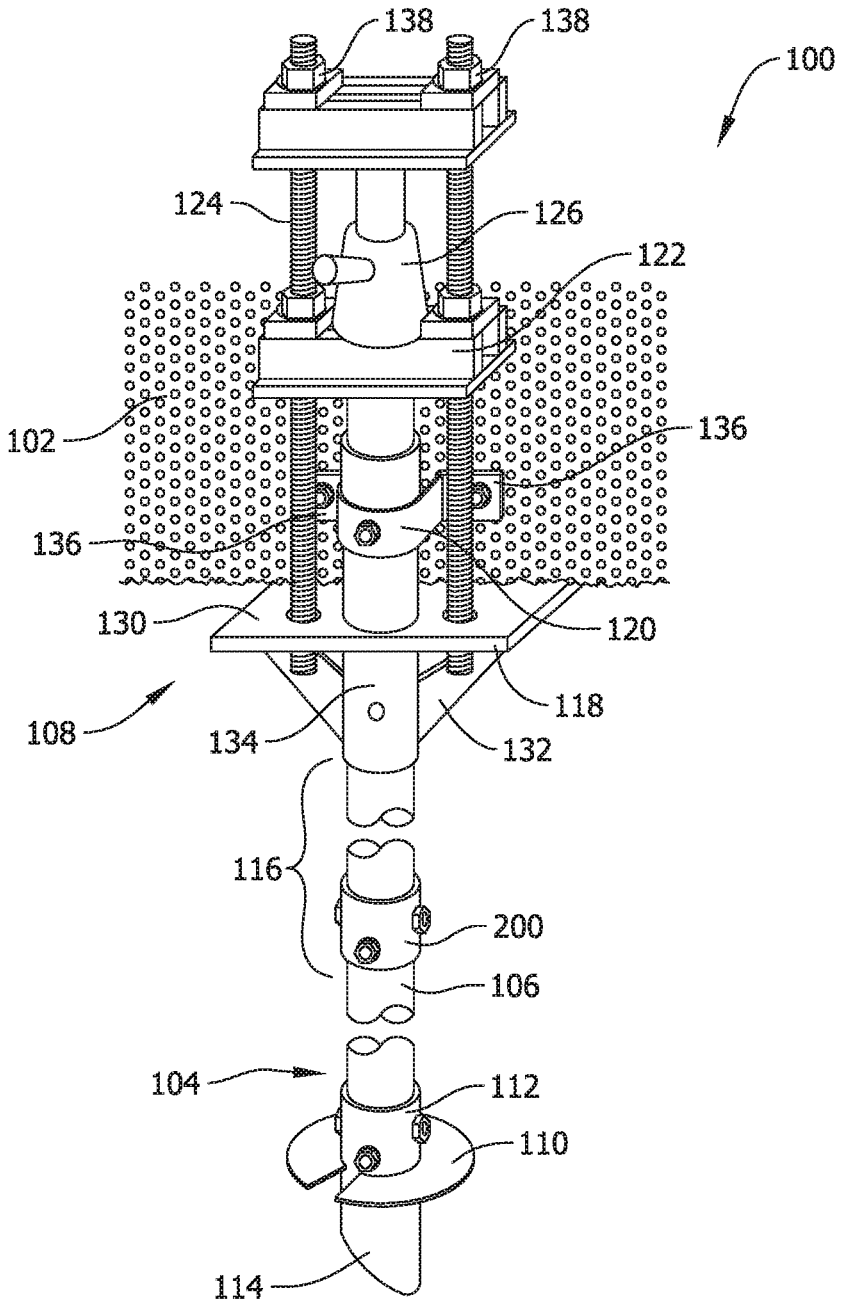
FIG. 1 illustrates a perspective view of a first exemplary embodiment of a foundation support system interacting with a building structure.

Exemplary embodiments of interlocking, self-aligning coupler assemblies to connect structural elements such as foundation elements of a foundation support system and related methods of assembling, connecting installing and supporting building foundation elements are described that address certain problems and disadvantages in the art. As described below, an interlocking self-aligning and torque transmitting coupler assembly of the present invention facilitates a simplified alignment and connection between, for example, a piling and an extension piece during assembly of a building foundation support system, while ensuring that an adequate lifting strength and support is reliably established by avoiding installation issues that can otherwise be problematic when subjected to torque to drive the pilings deeper into the ground. Foundation support elements may therefore be assembled more quickly and more reliably while reducing labor costs and simultaneously improving system reliability by avoiding problematic torque-related issues that can otherwise cause elements of a foundation support system to deform and negatively impact the stability of the system and its load bearing capacity.

More specifically, the support system described herein includes an interlocking, self-aligning, torque transmitting coupler assembly that includes first and second couplers and a plurality of mating alignment and torque transmission features provided in each coupler that assist in attaching first and second structural elements to each other with relative ease while ensuring proper alignment of the connections made, including but not limited to connections between foundation elements in a foundation support system. Multiple and different features are provided in each coupler in the coupler assembly that serve dual purposes of facilitating alignment and reliable connection of foundation elements in the field, as well as to more effectively transmit torque between the foundation elements after the aligned connections are established.

In a contemplated embodiment, the inventive coupler assembly includes a first or inner coupler attached to a first foundation element including a first shaft and an outer coupler attached to a second foundation element including a second shaft. The inner coupler includes a pair of primary alignment and torque transmitting ribs formed on a round outer surface thereof that are configured to be slidably inserted into a respective pair of primary alignment and torque transmitting grooves formed in a round inner surface of the outer coupler. As such, when the first and second foundation elements are desired to be attached, the inner coupler is inserted partly into the outer coupler and rotated about its center axis until the primary alignment and torque transmitting ribs of the inner coupler align and mate with the primary alignment and torque transmitting grooves of the outer coupler where complete mating engagement of the inner and outer couplers may occur. Only when the alignment and torque transmitting features are fully mated can the inner coupler be completely received in the outer coupler to complete a connection between the first and second shafts while also effectively mechanically isolating any fasteners provided from torque as a foundation support system is installed. By virtue of the inventive coupler assembly, torsional force applied to one of the foundation elements is transmitted to the other by the engagement of the torque transmission features formed in the inner and outer couplers.

In another contemplated embodiment, a fastened connection of the inner and outer couplers may include a cross-bolt connection wherein first and second bolts respectively extend through pairs of fastener holes or fastener openings formed in the respective inner and outer coupler. The fastener holes are self-aligning when the inner and outer couplers are completely engaged and the first and second bolts extend in mutually perpendicular directions through the fastener holes. The first and second bolts also extend at offset elevations to one another in the coupler assembly. Advantageously, no fastener holes in the pile and extension piece are needed to make the cross-bolt connection via the inner and outer coupler. Alignment difficulties associated with fastener holes in the pile and extension piece are completely avoided.

In other contemplated embodiments, however, a single fastener may be utilized to complete a connection between the first and second shafts through the coupler assembly and as such a single pair of fastener holes may be provided in each of the inner and outer couplers that are self-aligning when the inner and outer couplers are engaged.

In still another contemplated embodiment the mechanical connection between the shafts may be completed without using any fasteners via the interlocking alignment and torque transmitting features formed in the inner and outer couplers.

As described in further detail below, an exemplary embodiment of a coupler assembly is self-aligning and self-locking in a manner that enables quick and easy coupling of first and second shafts, and in some cases accommodates a sturdy and easily accomplished cross-bolt fastening connection between the first and second shafts in a desirable manner. Any torque imparted onto the coupled shafts via twisting of the upper shaft is contained within interlocking features of the coupler assembly as opposed to being transferred through bolted connections between the shafts in conventional support systems. Method aspects of the inventive concepts will be in part apparent and in part explicitly discussed in the following description.

FIG. 1 illustrates a perspective view of an exemplary embodiment of a foundation support system 100 interacting with a building foundation 102 of a structure. The foundation support system 100 may interact with new foundation upon which a structure is to be built, or may alternatively interact with a foundation supporting an existing structure. That is, the foundation support system 100 may be applied to new building construction projects as well as to existing structures for maintenance and repair purposes. Of course, the support system 100 may alternatively be used to support an object other than a building foundation as desired.

After determining, according to known engineering methodology and analysis, how the foundation 102 or other structure needs to be supported, primary piles or pipes (hereinafter collectively referred to as a "pile" or "piles") 104 of appropriate size and dimension may be selected and may be driven into the ground or earth at a location proximate or near the foundation 102 using known methods and techniques. The primary piles 104 typically consist of a long shaft 106 driven into the ground, upon which a support element such as a plate or bracket (not shown) or a lifting element such as the lifting assembly 108 is assembled. The shaft 106 of the primary pile 104 may include one or more lateral projections such as a helical auger 110. The piles 104 may be, for example, helical steel piles available from Pier Tech Systems (www.piertech.com) of St. Louis, Mo., although other suitable piles available from other providers may likewise be utilized in other embodiments.

The helical auger 110 may in some embodiments be separately provided from the piling 104 and attached to the piling 104 by welding to a sleeve 112 including the auger 110 provided as a modular element fitting. As such, the sleeve 112 of the modular fitting is slidably inserted over an end of the shaft 106 of the piling shaft 104 and secured into place, for example with fasteners such as the bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly, as described in further detail below. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 (comprising allthread rods, for example) and accompanying hardware. In another suitable embodiment the lifting assembly 108 may also include a jack 126 and a jacking block 128. Suitable lifting assemblies may correspond to those available from Pier Tech Systems (www.piertech.com) of St. Louis, Mo., including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned and to accommodate one of the primary pile 104 or an extension pile 116. The housing 134 is generally perpendicular to the surface of lift plate 130 and extends above and below the plane of lift plate 130.

In the exemplary embodiment shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the exemplary embodiment, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternately, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of St. Louis, Mo. and other providers, any of which may be utilized in other embodiments of the foundation support system.

As shown in FIG. 1, the exemplary foundation support system 100 includes a coupler assembly 200 according to an embodiment of the present invention that establishes a mechanical connection between the shaft 106 of the primary pile 104 and the shaft of the extension pile 116. It is appreciated, however, that more than one coupler assembly 200 may be utilized to connect another extension pile 116 to the extension pile 116 or to mechanically connect other ones of the foundation elements 112, 134 to the respective piles 104 and 116 shown and described above. Further, it should be appreciated that the coupler assembly 200 may be utilized in a foundation support system 100 that does not include an extension pile 116. For example, the coupler assembly 200 could establish a connection between the pile 104 and the housing 134, or between the pile 104 and the sleeve 112 of the modular fitting. The coupler assembly 200 may accordingly facilitate a modular assembly of the foundation elements shown and described in various combinations.

Figure 2:
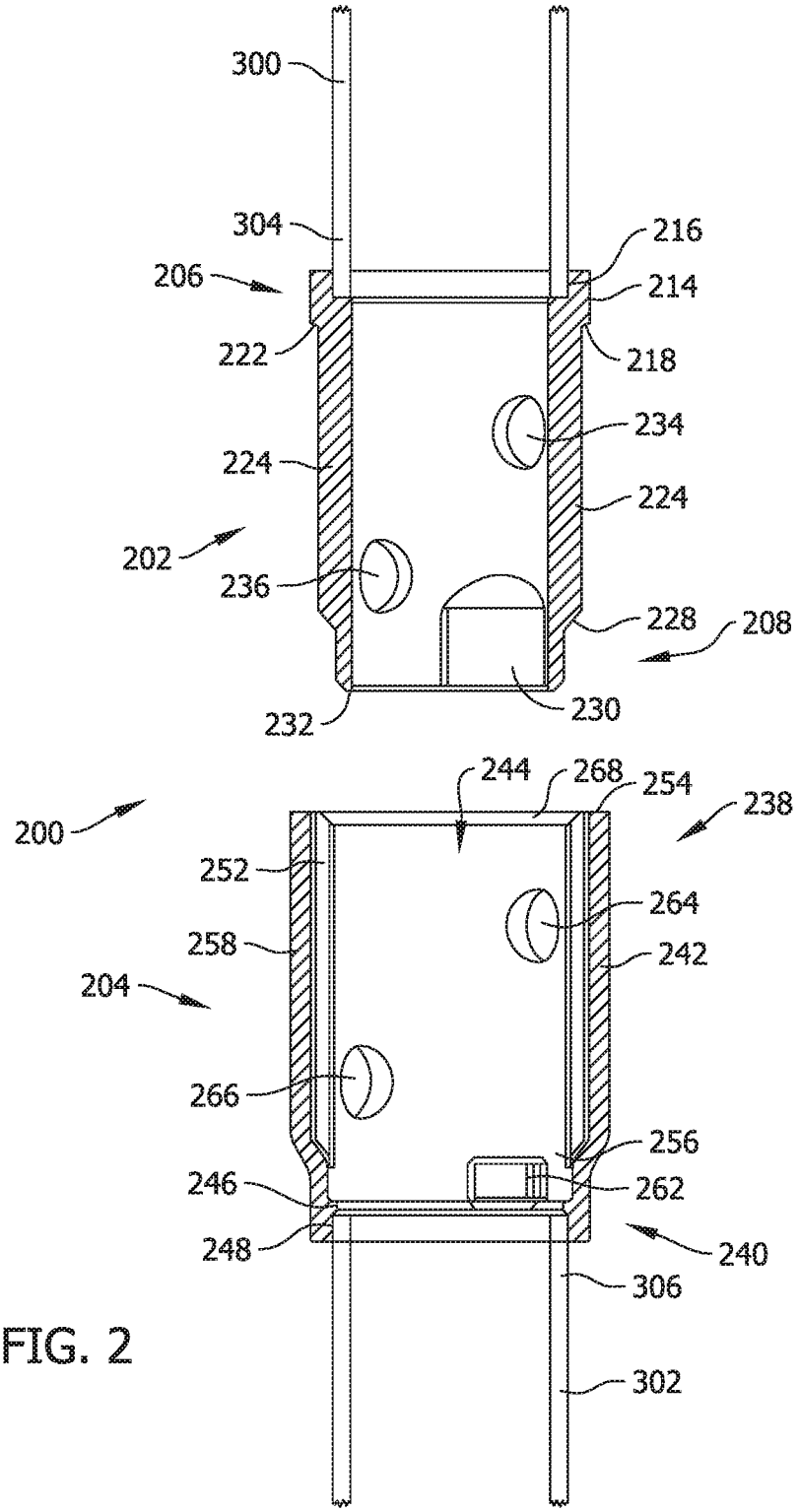
FIG. 2 shows a cross-sectional view of a first exemplary embodiment of a piling assembly for the system shown in FIG. 1 including a n exemplary coupler assembly according to a first embodiment of the present invention and including an inner coupler and an outer coupler.

FIG. 2 shows the coupler assembly 200 in cross-sectional view wherein the coupler assembly 200 is seen to include an inner coupler 202 attached to a shaft of a first piling 300 and an outer coupler 204 attached to a shaft of a second piling 302. In one embodiment, pilings 300 and 302 include a length of pipe fabricated from a metal such as steel. The couplers 202, 204 may likewise be integrally formed from a metal material such as steel according to known techniques to include the features described. The first piling 300 may be of the same dimension in terms of its inner and outer diameter and correspond in cross sectional shape to the second piling 302, to which it is attached. Alternatively stated, the pilings 300, 302 being connected via the coupler assembly 200 are constructed to be the same, albeit with possibly different lengths, although this not necessarily required in all embodiments. The cross-sectional shape of the pilings 300, 302 can be circular, square, hexagonal, or another shape as desired. The pilings 300, 302 can be made to different lengths, however, as the application requires, and the pilings 300, 302 can be hollow or filled with a substance such as concrete, chemical grout, or another known suitable cementitious material or substance familiar to those in the art to enhance the structural strength and capacity of the pilings in use. The pilings may be prefilled with cementitious material in certain contemplated embodiments.

Likewise, in other contemplated embodiments, cementitious material, including but not necessarily limited to grout material familiar to those in the art, may be mixed into the soil around the pilings 300, 302 as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the pilings to direct a flow of cementitious material through the pilings and at selected locations into the surrounding soil.

In the exemplary embodiment shown, the first piling 300 may correspond to an extension piling, such as the extension piling 116 shown in FIG. 1, and the second piling 302 may correspond to a primary piling, such as the primary piling 104 shown in FIG. 1. As noted above, the coupler assembly 200, however, may alternatively be used to connect other shafts of other foundation elements in the foundation support system 100 previously described, or still further may be utilized to connect other structural shaft elements in another application apart from foundation support. In the exemplary embodiment shown, the shaft of the first piling 300 includes a distal end 304, to which is coupled the inner coupler 202, and the shaft of the second piling 302 includes a distal end 306, to which is coupled the outer coupler 204. The distal ends 304 and 306 are positioned adjacent each other such that the inner coupler 202 is configured to be at least partially inserted into the outer coupler 204, as described in further detail below.

Figure 3:
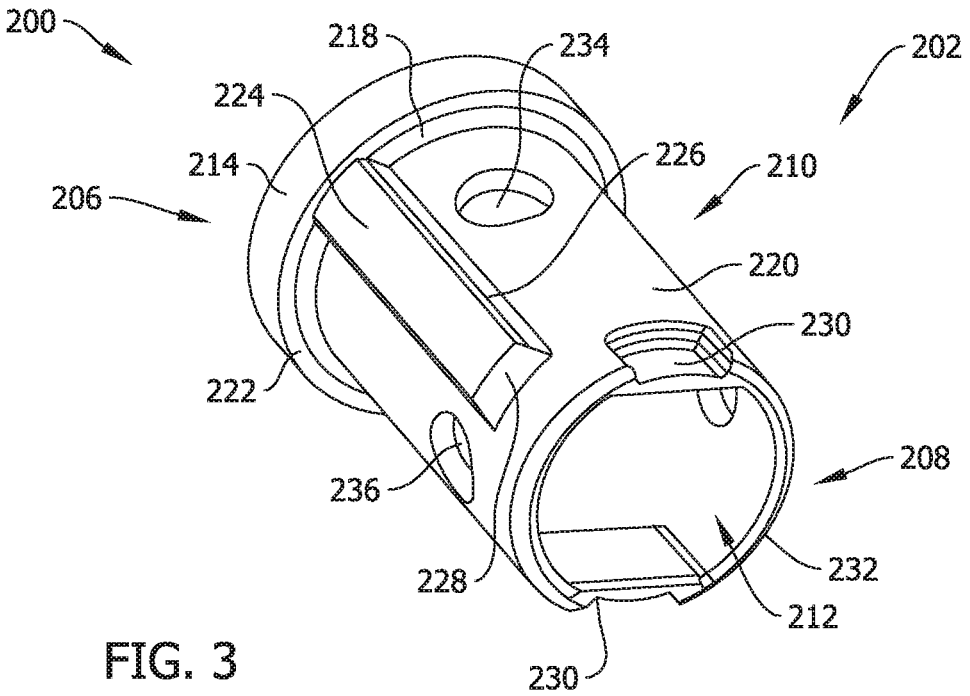
FIG. 3 illustrates a perspective view of the inner coupler for the coupling assembly shown in FIG. 2.
Figure 4:
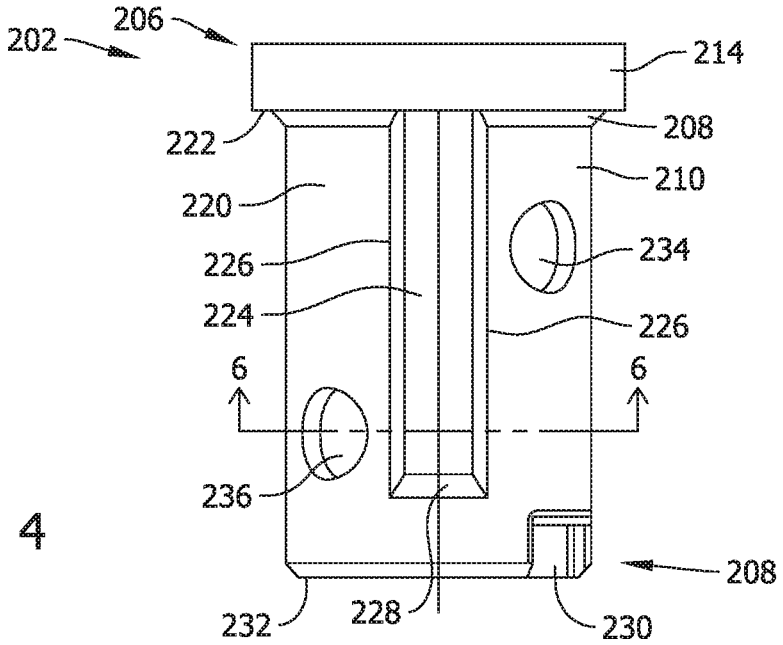
Figure 5:
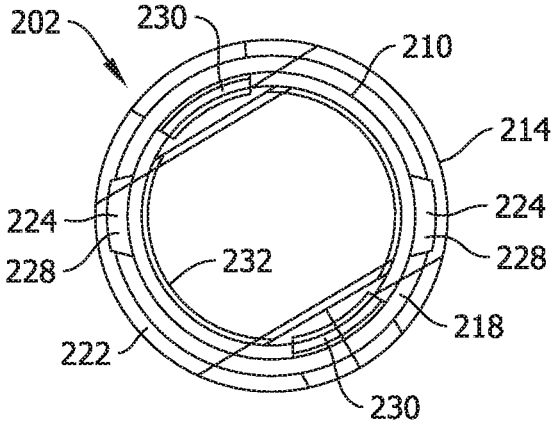
FIG. 5 illustrates a bottom view of the inner coupler shown in FIG. 3.
Figure 6:
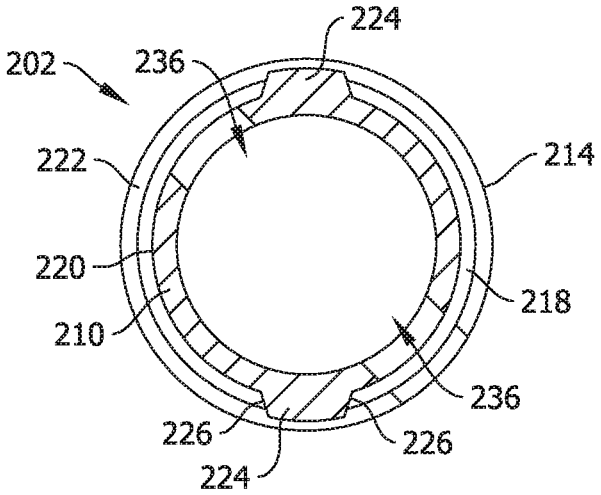
FIG. 6 illustrates a cross-sectional view of the inner coupler taken along line 6-6 in FIG. 4.

FIGS. 3, 4 and 5 respectively illustrate a perspective view, bottom view and rear cross-sectional of the inner coupler 202 of the coupler assembly 200 that will be described collectively in the following discussion.

In the exemplary embodiment illustrated, the inner coupler 202 includes a first end 206, a second end 208, and a hollow round body portion 210 extending therebetween. The inner coupler 202 accordingly includes a generally round opening 212 extending therethrough between the ends 206, 208. The first end 206 includes a collar portion 214 including a counter bore 216 configured to receive the distal end 304 of the shaft of the first piling 300. In the exemplary embodiment shown, the counter bore 216 includes an inner diameter or circumference that is sized, shaped and dimensioned to be large enough to accommodate the outer diameter of the shaft of the piling end 300 (FIG. 2) such that when the piling end 304 is inserted into the counter bore 216 the end of the shaft is received in the counter bore 216. In an alternative embodiment, the outer diameter of the collar 214 may be selected to be small enough to fit within the inner diameter of the shaft of the piling end 300. Regardless, the shaft of the first piling 300 is fixedly attached to the inner coupler 202 by any known means, such as, but not limited to, welding. As previously mentioned, the shaft may include a round cross-section, a square cross-section, or another cross-sectional shape, and accordingly the end 206 of the inner coupler 202 has a complementary round shape, square shape or other shape to facilitate the connection of the shaft end to the counter bore 216.

As further seen in the figures, the body portion 210 of the inner coupler 202 is attached to the collar 214 via a seating surface 218. More specifically, the seating surface 218 obliquely extends between an outer surface 220 of the body portion 210 and a lip surface 222 of the collar 214.

The inner coupler 202 also includes a pair of axially extending ribs 224 that project or extend radially outward from the round outer surface 220 of the body portion 210. In the exemplary embodiment, the axially extending ribs 224 are positioned opposite each other on the round body 210 of the inner coupler 202. That is, the ribs 224 are extended about 180° from one another on an outer surface of the round body 210, and extend lengthwise or in a direction parallel to a longitudinal axis of the shafts that are connected with the coupler assembly.

In another suitable embodiment, the ribs 224 are positioned at any point on the round body 210 that facilitates operation of the coupler assembly 200 as described herein. Each rib 224 includes a pair of side surfaces 226 and a seating surface 228 that each extends obliquely from round outer surface 220 of the body 210. The ribs 224 serve as a primary alignment feature to align the inner coupler 202 with the outer coupler 204 to enable connecting the first piling 300 to the second piling 302 as well as a primary torque transmitting feature when the inner coupler 202 is mated to the outer coupler 204. More specifically, the pair of ribs 224 are configured to cooperatively engage a pair of grooves defined in the outer coupler 204 to accomplish alignment and torque transmission, as described in further detail below. While a pair of ribs 224 are shown, it is understood that greater or fewer number of ribs may likewise be provided in further and/or alternative embodiments.

In the exemplary embodiment shown, the inner coupler 202 also includes a secondary alignment and torque transmission feature that includes a pair of circumferentially extending recesses 230 defined in the round body 210 proximate the second end 208 of the inner coupler 202. Specifically, the circumferential recesses 230 extend from an end surface 232 of the inner coupler second end 208 partly around the circumference of the body 210. Similar to the ribs 224, the recesses 230 are configured to engage a pair of projections defined in the outer coupler 204, as described in further detail below. Further, the recesses 230 are circumferentially offset from the ribs 224, such that the recesses 230 and the ribs 224 are not aligned with one another. In another suitable embodiment, the recesses 230 may be circumferentially aligned with the ribs 224 if desired. While a pair of circumferential recesses 230 are shown, it is understood that greater or fewer number circumferential recesses 230 may likewise be provided in further and/or alternative embodiments. As best seen in FIG. 5, at the locations of the circumferential recesses 230, the inner surface of the coupler 202 includes flat regions that maintain a desired wall thickness in the coupler body 210. As such, inner surface of the coupler 202 in cross-section seen in FIG. 5 includes two rounded curve portions separated by straight or linear portions at the locations of the recesses 230 whereas the inner surface of the coupler 202 is otherwise uniformly round and circular in cross section at other locations in the body 210 as shown in the figures.

The inner coupler body portion 210 in the example illustrated also is formed with one or more pairs of fastener holes or openings 234, 236 defined therethrough to allow for fastening of the inner coupler 202 and the outer coupler 204. The two openings 234 are shown on opposite sides or locations in the round body portion 210 such that a fastener such a bolt extending through the openings 234 will be generally perpendicular to the longitudinal axis and will enter and leave the body portion 210 approximately normal to the round outer surface 220. In a further embodiment, the body portion 210 includes the first pair of openings 234 proximate the first end 206 and a second pair of openings 236 located proximate the second end 208. The pairs of openings 234 and 236 are angularly offset from one another by 90° such that fasteners inserted into the openings 234 and 236 are mutually perpendicular to one another when received through the respective openings 234, 236. This particular configuration is sometimes referred to as a cross-bolt connection and is shown in FIG. 1 wherein the coupler assembly 200 connects the shafts 106 and 116.

Figure 7:
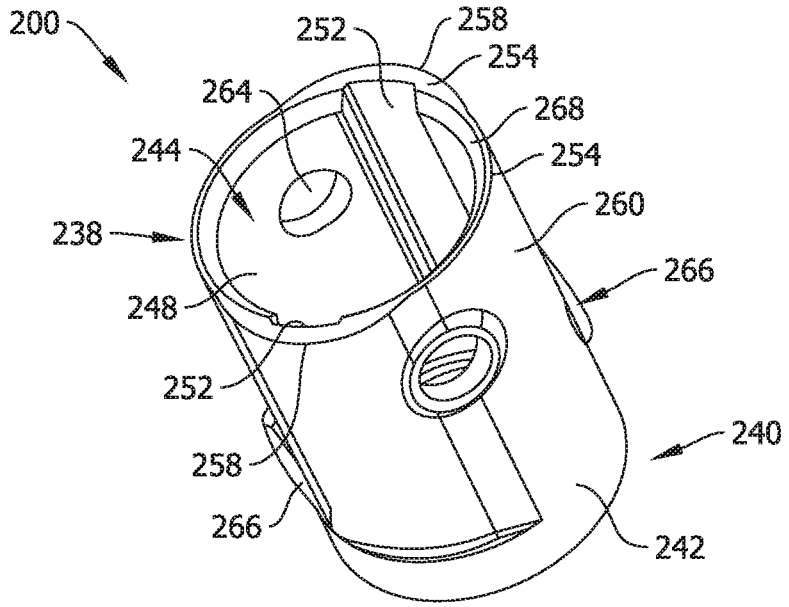
FIG. 7 illustrates a perspective view of the outer coupler shown in FIG. 2.
Figure 8:
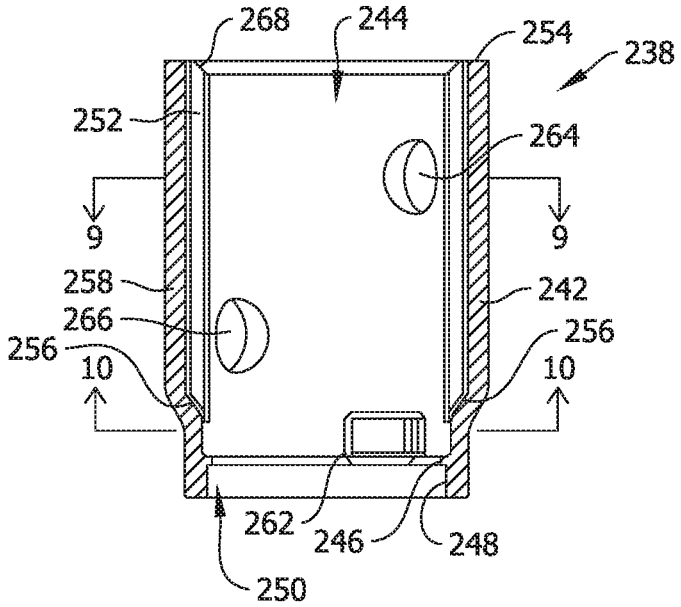
FIG. 8 illustrates a cross-sectional view of the outer coupler shown in FIG. 7.
Figure 9:
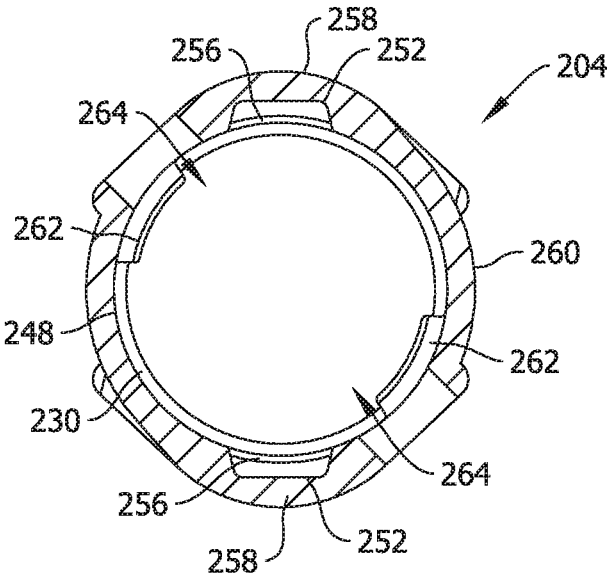
FIG. 9 illustrates a cross-sectional view of the outer coupler taken along line 9-9 in FIG. 8.
Figure 10:
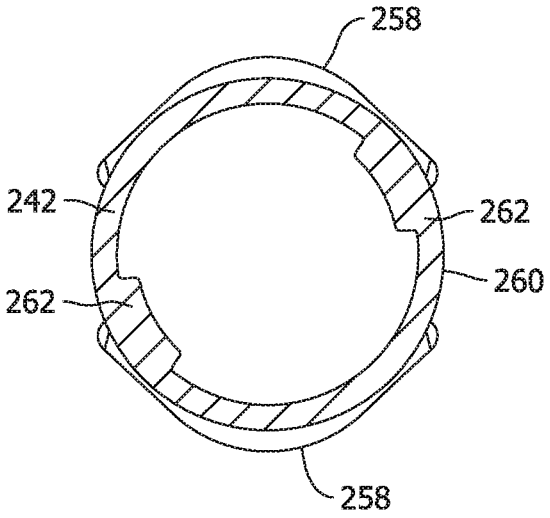
FIG. 10 illustrates a cross-sectional view of the outer coupler taken along line 10-10 in FIG. 8.

FIG. 7 illustrates a perspective view of the outer coupler 204 of the coupling assembly 200 that may be used with the foundation support system 100 shown in FIG. 1 and the inner coupler 202 shown in FIGS. 3-6. FIG. 8 illustrates a cross-sectional view of the outer coupler 204. FIG. 9 illustrates a cross-sectional view of the outer coupler 204 taken along line 9-9 in FIG. 8. FIG. 10 illustrates a cross-sectional view of the outer coupler 204 taken along line 10-10 in FIG. 8. The following discussion shall collectively refer to FIGS. 7-10.

In the exemplary embodiment shown, the outer coupler 204 includes a first end 238, a second end 240, and a hollow round body portion 242 extending therebetween. The outer coupler 204 accordingly includes an opening 244 extending between ends 238 and 240. As shown in FIG. 8, the second end 240 includes a flange 246 extending from an inner surface 248 of the round body 242. The flange 246 defines a cavity 250 at the second end 240 that configured to receive the distal end 306 of the shaft of the second piling 302. In the exemplary embodiment, the cavity 250 includes an inner diameter that is large enough to accommodate the outer diameter of the shaft at the piling end 306 such that the shaft of the piling end 306 is inserted in to the cavity 250 to join the outer coupler 204 with the second piling 302. In another suitable embodiment, at least a portion of the outer diameter of the second coupler body 242 is small enough to fit within the inner diameter of shaft of the piling end 306. The shaft of the second piling 302 is fixedly attached to the second end 240 of the outer coupler 204 by any known means, such as, but not limited to, welding. As previously mentioned, the shaft of the second piling 302 may include a round cross-section, a square cross-section, or another cross-sectional shape, and accordingly the end 240 of the outer coupler 204 has a complementary round shape, square shape or other shape to facilitate the connection of the shaft end to the coupler 204. It should also be noted here that the couplers 202, 204 may be configured to receive and connect to shafts having different cross sectional shapes as desired in further and/or alternative embodiments.

The outer coupler 204 also includes a pair of axially extending grooves 252 that are formed in the round inner surface 248 and extend from a first end surface 254 toward the second end 240. In the exemplary embodiment, the grooves 252 are positioned opposite each other on the body 242 of the outer coupler 204. In another suitable embodiment, the grooves 252 are positioned at any point on the body 242 that facilitates operation of the coupler assembly 200 as described herein. The grooves 252 are configured to receive the pair of ribs 224 of the inner coupler 202 as a primary alignment feature with the inner coupler 202 to more easily connect the shaft of first piling 300 to the shaft of the second piling 302, as well as transmit torque in a manner contained within the coupler assembly. Each groove 252 includes a seating surface 256 proximate the second end 240 that is configured to mate with the seating surface 228 on a rib 224 of the inner coupler 202, as described in further detail below.

In the exemplary embodiment, the outer coupler 204 also includes a pair of wings or flares 258 that extend outward from a round outer surface 260 of the outer coupler body 242. Each wing or flare 258 is positioned approximate the respective groove 252 such that the wings or flares 258 facilitate a substantially constant thickness of the outer coupler body 242. Each wing or flare 258 extends from the end surface 254 toward the second end 240 and terminates at approximately the same axial position at the groove 252. The wings or flares 258 impart a rounded outer surface having a discontinuous outer diameter in the outer surface of the outer coupler 204. As seen in the cross sections of FIGS. 9 and 10, the outer coupler has an eccentric, complex curvature and elliptical shape where the rings or flares 258 reside.

The outer coupler 204 also includes a secondary alignment and torque transmission feature that includes a pair of circumferential projections in the form of tabs 262 extending outwardly from the round body portion 242 proximate the second end 240. Specifically, the circumferential projections 262 extend radially inward from the inner surface 248 proximate the flange 246. The circumferential projections 262 are configured to engage the pair of circumferential recesses 230 defined in the inner coupler 202 when the coupler assembly 200 is assembled. Further, the circumferential projections 262 are circumferentially offset from the grooves 252 in the outer coupler, such that the projections 262 and the grooves 252 are not aligned. In another suitable embodiment, the projections 262 may be circumferentially aligned with the grooves 252.

Additionally, the outer coupler body portion 242 may be formed with one or more pairs of fastener holes or openings 264, 266 defined therethrough to allow for joining of the outer coupler 204 to the inner coupler 202. Two openings 264 may be formed on opposite sides of the body portion 242 such that a fastener extending through openings 264 will be generally perpendicular to the longitudinal axis and will enter and leave the body portion 242 approximately normal to the surface 260. In a preferred embodiment, the body portion 242 includes the first pair of openings 264 proximate the first end 238 and a second pair of openings 266 located proximate the second end 240. The pairs of openings 264 and 266 are preferably rotationally offset from one another by 90° such that fasteners inserted into the openings 264 and 266 are perpendicular to one another when coupler assembly 200 is viewed in cross-section. This orientation of fastener holes facilitates a cross-bolt connection as described above.

As mentioned above, however, the cross-bolt connection is not required in all embodiments, however, and instead one fastener may be employed to complete a connection with the coupler assembly 200 in another embodiment. Still further, a mechanical connection may be completed without a fastener at all in certain applications as explained further below.

Although the inner coupler 202 is shown and described herein as including ribs 224 and outer coupler 204 is described herein as having grooves 252, it is contemplated that this arrangement of features may be reversed and/or combined in another embodiment. That is, in an alternative embodiment the inner coupler 202 may include grooves instead of or in addition to ribs 224, and the outer coupler 204 may likewise include ribs instead of or in addition to grooves 252. Further, the inner coupler 202 may include at least one of each a rib and a groove, while outer coupler may include a corresponding rib and a corresponding groove. Similarly, although the inner coupler 202 is described herein as including the circumferential recess 230 and the outer coupler 204 is described herein as having the circumferential projection 262, it is contemplated that the inner coupler 202 may include a circumferential projection instead of or in addition to the circumferential recess 230, and that the outer coupler 204 may include a circumferential recess instead of or in addition to projection 262. Generally, the inner coupler 202 includes at least one alignment and torque transmission feature that is configured to engage with a corresponding alignment and torque transmission feature of the outer coupler 204 to facilitate alignment of the couplers 202 and 204 to couple shafts of different foundation elements in the foundation support system.

Further, although ribs 224 and grooves 252 are shown as substantially linear, axially extending features oriented in parallel with the longitudinal axis of the shafts of the piles to which they are coupled, it is contemplated that the ribs 224 and grooves 252 may be in a non-parallel orientation with respect to the longitudinal axis of the shafts of the piles, such as obliquely-oriented. Additionally, it is contemplated that ribs 224 and grooves 252 may be non-linear in nature and form a curved shape such as, but not limited to, a spiral shape about their outer and inner surfaces of the respective couplers 202 and 204.

Referring again to FIG. 2, the coupler assembly 200 facilitates connecting the shaft of the first piling 300 with the shaft of the second piling 302. As described above, the first piling 300 may be an extension piling 116 (shown in FIG. 1). The second piling 302 may be one of the primary piling 104 (shown in FIG. 1) or an extension piling 116.

In another suitable embodiment, the coupler assembly 200 may be utilized to connect any two structural shaft components and is not restricted to use within a foundation support system 100, as described herein. That is, the shafts being connected with the coupler assembly 200 need not be shafts of piles or piers or any of the components shown and described in the foundation support system described above, but instead other structural elements for other purposes. Provided that the ends of the structural elements being connected are shaped to fit the counter bores in the inner and outer couplers 202, 204, the structural elements need not even be shafts.

In operation, the inner coupler 202 is fixedly attached to the end 304 of the shaft of the first piling 300 and the outer coupler 204 is fixedly attached to the end 306 of the shaft of the second piling 302. The second end 208 of the inner coupler 202 is then partly inserted into the first end 238 of the outer coupler 204 such that at least a portion of the inner coupler 202 is received within the opening 244. The diameter of the inner coupler 202 at the location of the ribs 224 is larger than the inner diameter of the outer coupler inner surface 248 such that the inner coupler 202 can only be inserted into the outer coupler 204 in a predetermined orientation. More specifically, the diameter of the outer coupler 204 at the location of the grooves 252 is large enough to accommodate the diameter of the inner coupler 202 at the location of the ribs 224. As such, the ribs 224 of the inner coupler 202 must be aligned with the grooves 252 of the outer coupler 204 to assemble the coupler assembly 200. Once the second end 208 of the inner coupler 202 is partially inserted, simple rotation of the first piling 300 causes automatic alignment of the couplers 202 and 204. Because the pile 300 is relatively heavy, the inner coupler 202 once aligned will fall into place via gravitational force as the piling 300 is rotated to the point of alignment. Therefore, the ribs 224 and the grooves 252 serve as a self-alignment feature that makes it easier to connect the pilings 300 and 302 to each other.

Once the ribs 224 are aligned with the grooves 254, the inner coupler 202 may then be removably inserted into the outer coupler 204. Insertion terminates when the lip surface 222 and the seating surface 218 of the inner coupler 202 mate, respectively, with the end surface 254 and a seating surface 268 at the first end 238 of the outer coupler 204. As such, in the exemplary embodiment, the collar portion 214 of the inner coupler 202 remains exposed and is not inserted into the opening 244 of the outer coupler 204. In another suitable embodiment, the inner coupler 202 is fully inserted into the outer coupler 204.

Referring to the second ends 208 and 240, when the ribs 224 are fully inserted into the grooves 254, the seating surface 228 on the ribs 224 is in contact with the seating surface 256 on the grooves 254. Additionally, the end surface 232 on the inner coupler 202 contacts the flange 246 on the outer coupler 204. As such, seating surfaces 218, 268, 228, and 256, end surface 232, and flanges 246 are configured to ensure that the inner coupler 202 is properly positioned within the outer coupler 204 with respect to depth.

Furthermore, each circumferential recess 230 in the second end 208 of the inner coupler 202 receives a circumferential projection tab 262 in the second end 240 of the outer coupler 204 to further ensure proper alignment of the couplers 202 and 204 as well as torque transmission. Over time and through continued usage, it is possible that friction may erode away small portions of the ribs 224. However, the circumferential recesses 230 and projections 262 serve as a secondary alignment and torque transmission feature to facilitate assembly of the coupler assembly 200.

When the combination of alignment features have been properly seated and aligned between the couplers 202 and 204, the first piling 300 is spaced from the second piling 302 by a distance equal to the distance between the counter bore 216 in the inner coupler 202 and the flange 246 in the outer coupler 204. As such, the pilings 300 and 302 are not directly connected to the same component of the coupler assembly 200 and no component of the coupler assembly 200 overlaps both pilings 300 and 302. In such a configuration, any torque imparted onto the support system 100 is contained within the coupler assembly 200 instead of being transferred between the pilings 300 and 302 using fasteners such as bolts extending through fastener holes in the pilings 300 and 302. Advantageously, by virtue of the couplers 202 and 204, the connections can be established between the pilings 300 and 302 without fastener holes and fasteners extending through the pilings 300, 302. As clearly seen in the Figures, the fasteners, when provided extend only through the couplers 202, 204. As such, torque related issues associated with deformation of fastener holes in the pilings 300, 302 that may occur in conventional systems are eliminated by the coupler assembly 200.

More specifically, if the first piling 300 were to be rotated while the inner coupler 202 is positioned within and engaged with the outer coupler 204 to drive the pilings 300, 302 deeper into the ground, the torque is distributed in the coupler assembly 200 between the ribs 224 and the grooves 254, between the circumferential recesses 230 and the circumferential projections 262. Further, because the primary alignment and secondary alignment features described are differently sized and proportioned, as well as being offset and spaced apart from one another in the coupler assembly 200, any applied torque is distributed across multiple locations in the coupler assembly 200 where the alignment and torque transmitting features are engaged. Because some of the alignment and torque transmitting features are axially oriented while others are circumferential, a particularly strong and sturdy connection is realized that facilitates torque transfer without deformation of either coupler 202, 204 or the connecting shafts of the piles 300, 302. Finally, because the couplers 202 are each fabricated from high strength steel in a contemplated embodiment, they are capable of withstanding high torsional forces to install a foundation support system by driving piles into the ground. Simpler and easier connections of foundation elements such as piles are therefore realized with improved reliability that likewise facilitates simpler and easier installation of a foundation support system with improved reliability.

Further, in such a configuration, the first pair of fastener holes or openings 234 on the inner coupler 202 is automatically aligned with the first pair of fastener holes or openings 264 on the outer coupler 204 when the couplers 202, 204 are mated. Similarly, the second pair of fastener holes or openings 236 on the inner coupler 202 is automatically aligned with the second pair of fastener holes or openings 266 on the outer coupler 204. As such, a technician can easily insert a first fastener through openings 234 and 264 and a second fastener through openings 236 and 266 to secure the inner 202 to the outer coupler 204 and establish a cross-bolt connection. As such, the coupler assembly 200 configured as shown in the Figures is sometimes referred to as a cross-bolt and cross-lock coupler.

As mentioned above, a single fastener may also be utilized in another embodiment. In such a scenario, one of the pairs of fastener holes may be omitted in the construction of the couplers 202, 204 or only one of the pairs of fastener holes may be utilized to receive a fastener.

In still another embodiment no fasteners may be utilized and the couplers 202, 204 could either be formed without fastener holes at all or the fastener holes provided may simply not be utilized with fasteners. Because the pilings in the example of the foundation support system are driven and loaded with compression force in use, the fastened connection may not be strictly necessary because of the interlocking engagement of the alignment and torque transmission features that may transmit torsional force in the absence of any fasteners. The configuration of the couplers 202, 204 further facilitates direct and distributed transmission of compressive forces by the seating surfaces described on each coupler that mate with one another when the couplers 202, 204 are engaged. The flush engagement of the mating ends when the coupler assembly 200 is fully assembled, in combination with the seating surfaces described, provides a high strength connection in the assembly.

Such a configuration of coupler assembly 200 and shafts of the piles 300 and 302 reduces, and substantially eliminates the stress in the assembly that may otherwise result because of the difficulties in aligning relatively long and heavy pieces in the assembly. If fasteners are intentionally or unintentionally forced through openings that are not completely aligned in adjacent shafts in the assembly the joint between adjacent shafts may be subject to a significant amount of mechanical stress that in conventional systems may lead to deformation of the fastener holes and weakening of the shafts. Because the coupler assembly 200 is self-aligning, however, such issues are avoided.

Additionally, deformation of the fastener holes via unintentional misalignment of piles in conventional support systems may result in some relative movement, sometimes referred to as play, in the coupled connection that can also adversely affect the load bearing capacity of the system. Also, increased stress caused by misalignment of adjacent components may cause a reduction in the effective service life of the piles, thus requiring more frequent replacement. By virtue of the self-aligning and self-locking coupler assembly and system described, these problems are substantially minimized, if not completely eliminated, in most cases where the coupler assembly 200 is properly used. The inter-engagement of the coupler features described, and in particular the alignment and torque transmission features of each coupler 202 and 204, mechanically isolates the fasteners, when provided, from torsional force.

The fasteners, when utilized with fully engaged couplers 202, 204, are further mechanically isolated from compression forces in the coupler assembly 200 when the pilings are driven further into the ground via application of torsional force on and end of an above ground piling. The seating surfaces described in the coupler assembly 200 that bear upon and inter-engage with one another when the coupler assembly 200 is fully engaged, provide direct transmission of compression forces through the couplers 202, 204.

The fasteners provided may, however, realize tension force depending on how the support system is configured and applied. More specifically, the fasteners may experience a tensile load from a loading of a pile with a uplift force, or if the pile should need to be removed the fasteners when provided ensure that the connection maintains engagement.

Figure 11:
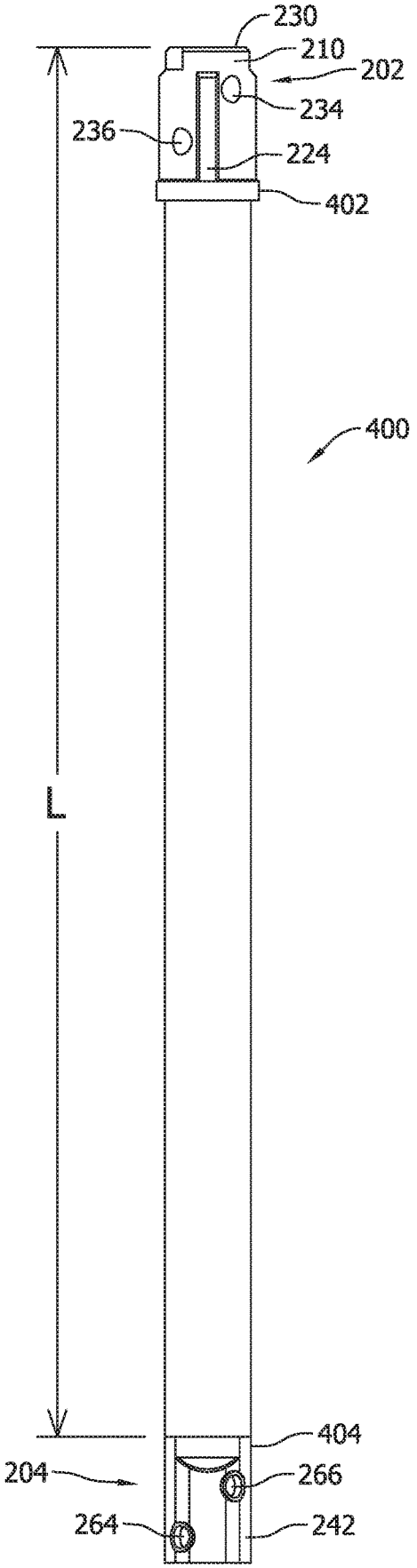
FIG. 11 illustrates an exemplary modular foundation support component including an inner coupler and an outer coupler as shown in FIGS. 3-10 for the assembly shown in FIG. 2 and the foundation support system shown in FIG. 1.

FIG. 11 illustrates an exemplary modular foundation support component 400 in the form of an elongated shaft with opposed ends 402, 404 and coupling features on each end 402, 404 that correspond to the inner coupler 202 and the outer coupler 204 in the coupler assembly 200 (FIG. 2) and as shown and described in FIGS. 3-10 as set forth above. The shaft 400 may be fabricated from steel in contemplated embodiments and has a length and cross section to meet the structural strength requirements of a foundation support assembly wherein the shaft 400 serves as a portion of a foundation support pile in a modular foundation support system. The shaft 400 may be hollow or filled with a cementitious material as described above.

In one embodiment, the coupling features of the couplers 202, 204 (e.g., the ribs 224, grooves 252, seating surfaces for coupler engagement, and fastener holes) may be integrally formed and cast in the fabrication of the shaft 400. In another embodiment, the coupling features of the couplers 202, 204 may be integrally swaged on the shaft ends 402, 404 in a forging process. In still another embodiment, the coupling features of the couplers 202, 204 may be provided separately and welded on the shaft ends 402, 404 via the respective coupler body portions 220, 242 described above. Other mechanical connections of the coupling features to the shaft 400 are possible. Whether integrally formed and built-in the fabrication of the shaft 400 or separately joined and connected, the coupling features of the couplers 202, 204 are provided for assembly in a modular foundation support system with the couplers 202, 204 present on the ends 402, 404.

The shaft 400 in contemplated embodiments may be configured as an extension piece or pile of a foundation support system such as the foundation support system 100 (FIG. 1) when both the coupler features are provided on both ends 402, 404 as shown. In another embodiment wherein coupler features are provided only on one of the ends 402 or 404, the shaft may be configured as a primary support pile with a helical auger component 110 and may have a beveled end or tip as shown in FIG. 1. The shaft 400 may alternatively be provided and used as a modular component in a coupled shaft assembly other than a foundation support assembly with similar effect and benefits.

The modular component shaft 400 as shown including the couplers on both ends may be quickly coupled to additional modular components that include a mating coupler 202, 204 with similar effects and advantages to those described above. For example, when the modular shaft component 400 is provided as a first modular component, a second modular component having an outer coupler 204 may be connected to the shaft end 402 including coupling features of the inner coupler 202, while a third modular component including an inner coupler 202 may be connected to the shaft end 404 including coupling features of the outer coupler 204. The connections may be beneficially made in a self-aligning manner as described above with the self-aligning fastener holes to quickly complete connections of the modular components in a highly reliable manner.

When the modular components being coupled are each elongated shaft components, when the corresponding couplers 202, 204 are engaged to complete a connection between two shafts, a coupled shaft component assembly is realized having a combined shaft length about equal to the axial lengths of the modular component shafts being assembled. An overlap of the inner and outer couplers when fully mated to facilitate the shaft connections is relatively small (e.g. six inches) in comparison to the axial lengths of the shafts in contemplated embodiments that are many feet long, such that the combined length of coupled shafts using the inner and outer couplers is slightly less than, but about equal to, the sum of the lengths of the modular shafts being assembled via the couplers 202, 204. As shown in FIG. 11, the modular shaft 400 has an axial length L measured end-to-end between the distal ends of the couplers 202, 204, with the axial length of the couplers 202, 204 on the shaft ends 402, 404 each contributing only a small fraction of the total axial length L.

By providing a set of modular shafts 400 (or modular shaft components to be assembled with the modular shaft 400) of respectively different axial length L, coupled shaft assemblies can be provided to effectively accommodate a wide variety of particular needs in the foundation support field with a limited set of modular components. For example, n number of modular shafts 400 may be provided each having a selected cross-sectional shape (e.g., circular) and dimension (e.g., diameter) to provide the structural strength required of a foundation support installation, but in respectively different axial lengths $L_n$.

Considering a case wherein n equals three, a first modular shaft may be provided with a large axial length $L_1$ of 84 inches (2.13 m), a second modular shaft may be provided with an intermediate axial length $L_2$ of 63 inches (1.6 m), and a third modular shaft may be provided with a small axial length $L_3$ of 42 inches (1.07 m). Such relatively large, relatively small and intermediate length shafts can be utilized alone and in combination to realize a versatile number of different foundation support piling lengths to meet the needs of a particular foundation support installation.

Following the example above, the set of three modular shafts 400 having lengths $L_1$, $L_2$, $L_3$ can be used to realize the following coupled shaft lengths in a foundation support pier installation.

TABLE 1

| Modular Shaft 1 | Modular Shaft 2 | Modular Shaft 3 | Approximate Coupled Shaft Length |
|---|---|---|---|
| $L_3$ (42 in.) | None | None | 42 in. |
| $L_2$ (63 in.) | None | None | 63 in. |
| $L_1$ (84 in.) | None | None | 84 in. |
| $L_2$ (63 in.) | $L_3$ (42 in.) | None | 105 in. |
| $L_1$ (84 in.) | $L_3$ (42 in.) | None | 126 in. |
| $L_1$ (84 in.) | $L_2$ (63 in.) | None | 147 in. |
| $L_1$ (84 in.) | $L_2$ (63 in.) | $L_3$ (42 in.) | 189 in. |

In view of Table 1, an installer having one complete set of three modular shafts $L_1$, $L_2$, $L_3$ can complete seven different foundation support piers having the coupled shaft lengths ranging from 42 inches to 189 inches on the same installation site or different installation sites. Also, two different foundation support piers of different combined length can be installed using a single set of three modular shafts with the lengths $L_1$, $L_2$, $L_3$.

The versatility of the modular shaft assembly is extended if multiple sets of modular shafts are made available on an installer. For instance, three sets of modular shafts 400 of lengths $L_1$, $L_2$, $L_3$ can be used separately and in combination to realize foundation support piers having the different lengths shown below in Table 2.

TABLE 2

| Modular Shaft 1 | Modular Shaft 2 | Modular Shaft 3 | Approximate Coupled Shaft Length |
|---|---|---|---|
| $L_3$ (42 in.) | None | None | 42 in. |
| $L_2$ (63 in.) | None | None | 63 in. |
| $L_1$ (84 in.) | None | None | 84 in. |
| $L_3$ (42 in.) | $L_3$ (42 in.) | None | 84 in. |
| $L_2$ (63 in.) | $L_3$ (42 in.) | None | 105 in. |
| $L_1$ (84 in.) | $L_3$ (42 in.) | None | 126 in. |
| $L_2$ (63 in.) | $L_2$ (63 in.) | None | 126 in. |
| $L_3$ (42 in.) | $L_3$ (42 in.) | $L_3$ (42 in.) | 126 in. |
| $L_1$ (84 in.) | $L_2$ (63 in.) | None | 147 in. |
| $L_1$ (84 in.) | $L_1$ (84 in.) | None | 168 in. |
| $L_1$ (84 in.) | $L_3$ (42 in.) | $L_3$ (42 in.) | 168 in. |
| $L_2$ (63 in.) | $L_2$ (63 in.) | $L_3$ (42 in.) | 168 in. |
| $L_1$ (84 in.) | $L_2$ (63 in.) | $L_3$ (42 in.) | 189 in. |
| $L_2$ (63 in.) | $L_2$ (63 in.) | $L_2$ (63 in.) | 189 in |
| $L_1$ (84 in.) | $L_2$ (63 in.) | $L_3$ (63 in.) | 210 in. |
| $L_1$ (84 in.) | $L_1$ (84 in.) | $L_1$ (84 in.) | 252 in. |

An installer having three complete sets of modular shafts with the lengths $L_1$, $L_2$, $L_3$ shown can therefore selectively use the modular shafts in the three sets to complete foundation support systems having eleven different coupled shaft lengths ranging from 42 inches to 252 inches with varying incremental coupled shaft length differences between the eleven possible coupled shaft lengths.

Some of the coupled shaft lengths (e.g., 84 inches, 126 inches, 168 inches) shown in Table 2 may beneficially be realized using different combinations and different numbers of the modular shafts to realize the coupled shaft length. This provides additional versatility to assembling a foundation support assembly in view of the availability of the modular components at any given time. For example, if an installer has two shafts with large length $L_1$ for a foundation support system installation, the 168 inch coupled shaft length may be obtained directly by assembling the two shafts, but if the same assembly has only one shaft with length $L_1$ as long as the installer also has two shafts of length $L_2$ the installer may still proceed to realize the 168 inch coupled shaft.

Table 3 below illustrates another example of coupled shaft lengths made possible with three sets of modular shafts including alternative shaft lengths $L_1$, $L_2$, $L_3$ to that shown in Table 2 and providing correspondingly different coupled shaft lengths and increments between coupled shaft lengths using different combinations of the modular shafts.

TABLE 3

| Modular Shaft 1 | Modular Shaft 2 | Modular Shaft 3 | Approximate Coupled Shaft Length |
|---|---|---|---|
| $L_3$ (48 in.) | None | None | 48 in. |
| $L_2$ (60 in.) | None | None | 60 in. |
| $L_1$ (84 in.) | None | None | 84 in. |

TABLE 3-continued

| Modular Shaft 1 | Modular Shaft 2 | Modular Shaft 3 | Approximate Coupled Shaft Length |
|---|---|---|---|
| $L_2$ (48 in.) | $L_2$ (48 in.) | None | 96 in. |
| $L_2$ (60 in.) | $L_3$ (48 in.) | None | 108 in. |
| $L_2$ (60 in.) | $L_2$ (60 in.) | None | 120 in. |
| $L_2$ (60 in.) | $L_3$ (48 in.) | $L_3$ (48 in.) | 126 in. |
| $L_1$ (84 in.) | $L_3$ (48 in.) | None | 132 in. |
| $L_1$ (84 in.) | $L_2$ (60 in.) | None | 144 in. |
| $L_3$ (48 in.) | $L_3$ (48 in.) | $L_3$ (48 in.) | 144 in. |
| $L_2$ (60 in.) | $L_3$ (48 in.) | $L_3$ (48 in.) | 156 in. |
| $L_2$ (60 in.) | $L_2$ (60 in.) | $L_3$ (48 in.) | 168 in. |
| $L_1$ (84 in.) | $L_1$ (84 in.) | None | 168 in. |
| $L_1$ (84 in.) | $L_3$ (48 in.) | $L_3$ (48 in.) | 180 in. |
| $L_2$ (60 in.) | $L_2$ (60 in.) | $L_2$ (60 in.) | 180 in. |
| $L_1$ (84 in.) | $L_1$ (84 in.) | None | 186 in. |
| $L_1$ (84 in.) | $L_2$ (60 in.) | $L_3$ (48 in.) | 192 in. |
| $L_1$ (84 in.) | $L_1$ (84 in.) | $L_1$ (48 in.) | 216 in. |
| $L_1$ (84 in.) | $L_1$ (84 in.) | $L_1$ (60 in.) | 228 in. |
| $L_1$ (84 in.) | $L_1$ (84 in.) | $L_1$ (84 in.) | 252 in. |

In view of Table 3, an installer having three sets of modular shafts with the lengths $L_1$, $L_2$, $L_3$ shown can selectively use the modular shafts to complete foundation support systems having seventeen different coupled shaft lengths ranging from 48 inches to 252 inches with varying incremental differences between the possible coupled shaft lengths.

Of course, the specific lengths $L_1$, $L_2$, $L_3$ of modular shafts illustrated in Tables 1 through 3 are exemplary only. Different values of $L_1$, $L_2$, and/or $L_3$, whether greater and lesser than the values shown in Tables 1 through 3, may be selected in another embodiment to achieve other coupled shaft lengths and other increments between possible shaft lengths. Additional modular shafts may be introduced having additional varying length (e.g., a selected length $L_4$ or $L_5$ that is different from $L_1$, $L_2$ and $L_3$) to realize other combinations of shafts to realize foundation pier or piles in other lengths using single sets of multiple sets of modular shafts.

Therefore, to a foundation pier or pile installer having a relatively small inventory of modular shafts 400 of different axial length $L_n$, assembly of modular systems is possible having a selected combined shaft length to meet the unique needs of particular projects at installation sites and/or soil conditions at each site. The installer need not order conventional shafts of specific lengths, sometimes of a custom fabricated length, to meet the unique needs of a particular installation. Delay associated with obtaining shafts ordered specifically for a given job site are avoided and jobs may be completed much more quickly using the modular shafts 400.

By virtue of the modular shafts 400 as described, a foundation pier or pile installer also need not undertake additional work to utilize conventional shafts that may be in hand, but which are not the optimal length for a given job. As an example of such a scenario, consider a job site that requires a foundation piling of 144 inch length to support a particular foundation in view of soil conditions at the foundation site, but the installer only has conventional 84 inch piles on hand. To avoid cost and delay of acquiring a (possibly custom fabricated) additional shaft or shafts to provide the ideal combined length of 144 inches, an installer may opt to use two of the 84 inch conventional shafts on hand to install the foundation support pile instead. Of course, this conventionally means that the combined shaft length exceeds the 144 inches needed and accordingly either means that the installer has to drive the coupled 86 inch shafts deeper into the ground to complete the installation, or cut off the excess shaft length at the top end and drill holes in the top shaft to make the required connections at the top end of the shaft to another component (e.g., a foundation support bracket) to complete the installation. Either way, installation time and difficulty is presented, and in the latter case, reliability issues may result via difficulty in properly aligning fasteners to complete connections, causing increased mechanical stress on the shafts and fasteners and deformation of the shafts and/or fasteners.

Following the examples above, however, the modular shafts 400 including the self-aligning coupler features as seen in Tables 1 and 2 may be quickly assembled having a combined shaft length of 147 inches (just above the required 144 inch length) on site without delay and avoid additional work required by longer shafts to drive them much farther into the ground or to cut off the excess shaft length and establish connections after cutting the upper shaft per the discussion above. Likewise, the modular shafts 400 shown in Table 3 can be assembled to the exact 144 inch length required of this installation and therefore requires no extra work to drive the piling into the ground beyond the point required. Over a large number of jobs, the modular shafts 400 can realize significant time and labor savings in completing jobs in these aspects. Considering that the fastener holes are self-aligning with one another to make connections between the couplers provided in the modular shafts of Tables 1 and 2 system reliability is practically ensured.

From a modular component manufacturer level or distributor level, the modular shafts 400 can quickly be provided to customer installers without customized fabrication and delay to provide custom fabricated shafts uniquely suited to meet specific requirements. In the scenario described above, if a particular foundation support system requires a piling shaft length of about 144 inches, the manufacturer or distributer can immediately ship a large and intermediate shaft 400 in the examples of Tables 1 and 2 or Table 3 (providing a combined shaft length of 147 inches or 144 inches) instead of custom fabricating one or more shafts to meet the desired 144 inch length and shipping them post-fabrication. Delay and increased costs of custom fabricated shafts at the manufacturer level and distributor level may therefore be reduced, if not eliminated using modular shafts 400.

Shafts 400 of different lengths as described may be quickly and easily connected to one another in modular form to establish the cross-bolt and cross-lock, rotational torque transmitting coupler benefits described above. The shafts 400 can be fabricated in different cross-sectional shapes including circular, square, hexagonal, or another shape as desired. Shafts 400 of different cross-sectional shape can easily be connected to one another via the couplers 202, 204 described.

Additional modular foundation support components may be provided for assembly with the modular shaft components 400. For example, a foundation support bracket could be provided with an outer coupler 204 for assembly with the shaft end 402 including the inner coupler 202, and a foundation support shaft including a beveled end 114 and helical auger 110 could be assembled to the end 404 of the shaft 400 via an inner coupler 402. More than one shaft 400 may be assembled between the foundation support bracket and a shaft including a beveled end and auger. Different type of brackets, different types of tips including beveled ends or other features, or different types of auger components and configurations may likewise be provided, in the same or different axial lengths, to complete various different types of modular foundation support systems including modular shaft(s) 400 or mating coupler features to meet the needs of specific installations.

While in the example shown, the shaft 400 includes the inner coupler 202 on the first end 402 and the outer coupler 204 on the second end 404, in an alternative embodiment the two ends 402, 404 of the shaft 400 could be provided with the same type of coupler (e.g., either the inner coupler or the outer coupler) instead of different types of couplers (e.g., inner coupler on one end and outer coupler on the other end as shown). So long as the respective ends 402, 404 of the modular shaft 400 are mated with the complementary inner or outer coupler of additional shafts 400 or other foundation support components having mating coupler features as discussed above, the beneficial cross-bolt and cross-lock, rotational torque transmitting coupler benefits described above may be realized in the mating modular components in the foundation support system.

Figure 12:
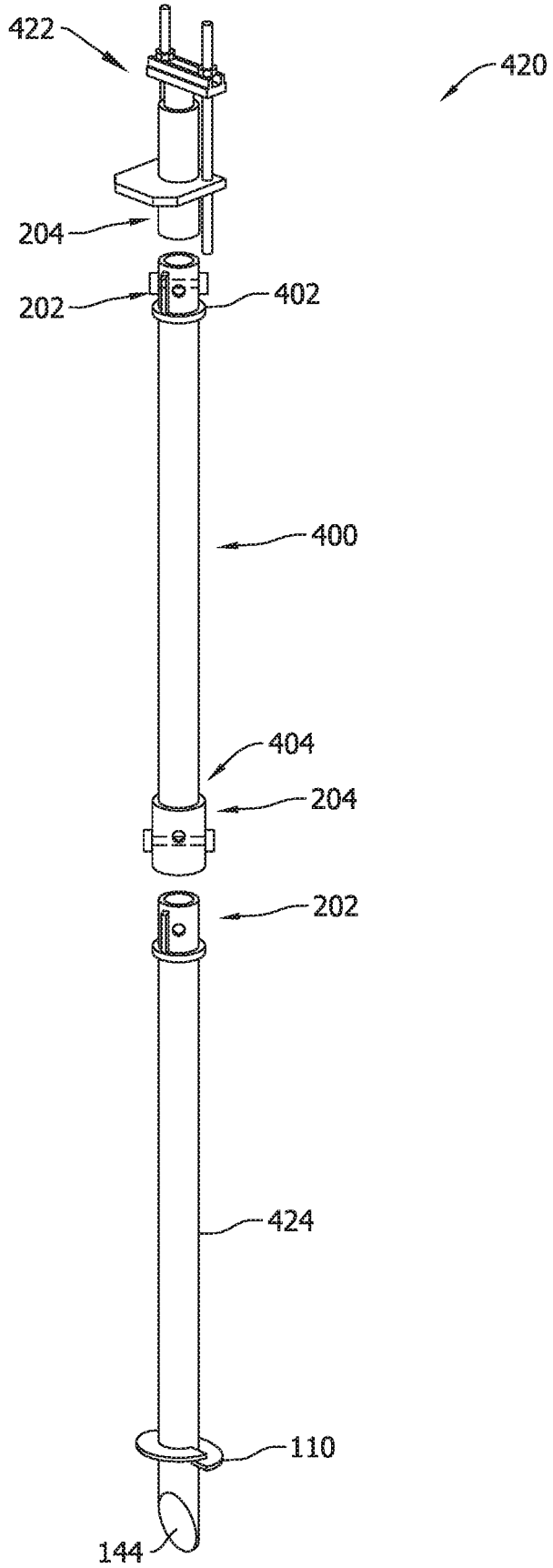
FIG. 12 illustrates a second exemplary embodiment of a modular foundation system including the modular foundation support component shown in FIG. 11.

FIG. 12 illustrates an exemplary embodiment of a modular foundation support system 420 including the modular foundation shaft 400 in the form of an extension support pile coupled to a foundation support bracket 422 including an outer coupler 204 for mating engagement with the inner coupler 202 on the first end 402 of the shaft 400. An end shaft 424 in the form of a primary support pile having an inner coupler 202 on end and the beveled tip 114 and auger 110 is coupled to the end 404 of the shaft 400 via the outer coupler 204. The auger 110 is shown coupled to the end shaft 110 at a distance from the beveled tip 114, although the auger 110 could be another modular component having a coupler 202 or 204. More than one auger 110 may be provided on the shaft 424, and more than one different type of auger may be provided on the end shaft 424 or for modular assembly to the end shaft 424 as separately provided modular components. The end shaft 424 may be provided in different axial lengths, in addition to the modular shaft being provided in different axial lengths, such that various combinations of end shafts and modular shafts may be selectively assembled to provide different combined pile lengths as described above.

As installed, the end shaft 424 is driven into the ground via the beveled tip 114 and auger 110 with the inner coupler 202 of the shaft 424 exposed. The outer coupler 204 of the shaft 400 at the end 404 is then mated with the exposed inner coupler 202 of the shaft 424 in the interlocking, self-aligning and torque transmitting manner described above. Cross-bolt fasteners may be inserted through each of the mated couplers 202, 204 via the fastener openings provided to positively secure the shafts 424 and 400, and the coupled shafts 400, 424 may then be driven further into the ground while the cross-bolt fasteners are mechanically isolated from torque transmission. The inner coupler 202 of the shaft 400 and the outer coupler 204 of the bracket assembly 422 are then mated in the interlocking, self-aligning manner described above, and the bracket assembly 422 is finally placed in position supporting the foundation. While one modular shaft 400 is shown between the bracket 422 and the end shaft 424, if needed or as desired, additional shafts 400 of the same or different length L may be assembled between the bracket 422 and the end shaft 424.

While FIG. 12 shows a particular coupling arrangement including inner and outer couplers 202, 204 connecting the mated components on each end 402, 404 of the shaft 400, the coupling arrangement could be effectively reversed in another embodiment. For example, the shaft 400 could be inverted for assembly to an end shaft 424 provided with an outer coupler 204 rather than an inner coupler 202 as shown in FIG. 12, and a bracket 422 may likewise be provided with an inner coupler 202 instead of the outer coupler 204 as shown for mating with the opposite end of the shaft 400 to that shown. Likewise, the shaft 400 could be provided with outer couplers 204 on each end for assembly with a bracket and end shaft including an inner coupler 402, or the shaft 400 could be provided with inner couplers 202 on each end for assembly with a bracket and end shaft including an outer coupler 404. As long as each component connection includes a mating inner and outer coupler, the locations or orientations of the inner and outer couplers in the respective components of the modular system may be varied.

Figure 13:
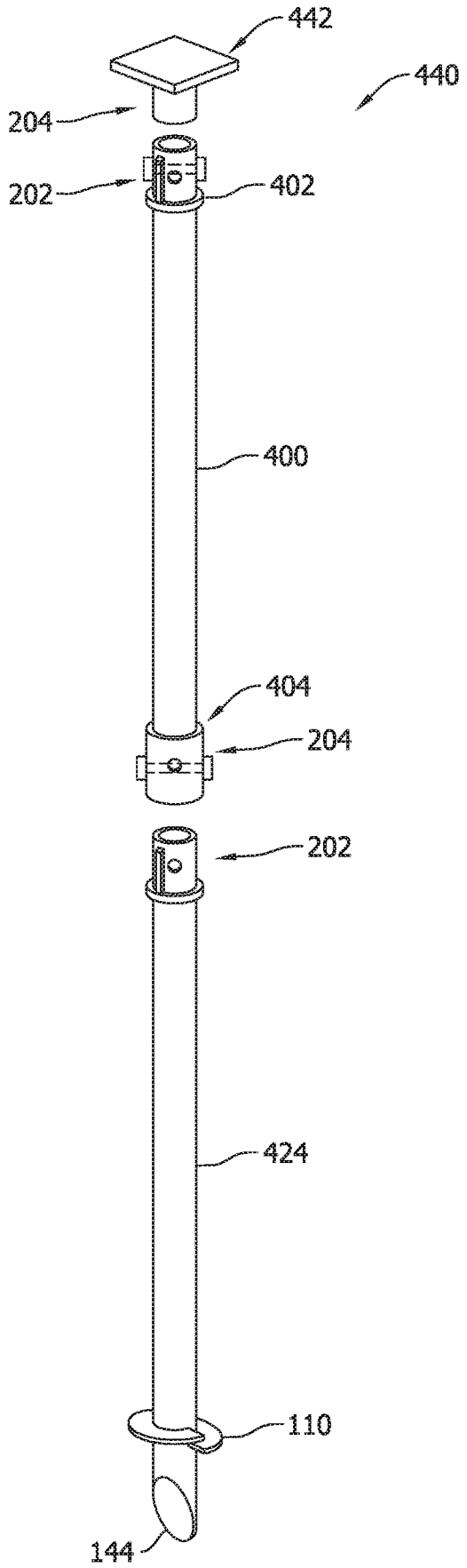
FIG. 13 illustrates a third exemplary embodiment of a modular foundation system including the modular foundation support component shown in FIG. 11.

FIG. 13 illustrates another exemplary embodiment of a modular foundation system 440 including the modular foundation shaft 400 in the form of an extension support pile coupled to a foundation support plate 442 including an outer coupler 204 which mates with the inner coupler 202 on the first end 402 of the shaft 400. The end shaft 424 in the form of a primary support pile having an inner coupler 202 on end and the beveled tip 114 and auger 110 opposite the inner coupler 202 is coupled to the outer coupler 204 at the end 404 of the shaft 400. The modular foundation support system 442 is installed in a similar manner to that described above. If needed, additional shafts 400 of the same or different length may be assembled between the bracket 442 and the end shaft 424.

It should now be realized that various different types of brackets, support plates, other types of support components, and various accessories as desired may be provided for modular assembly in a selected combination and in a selected shaft length to construct a foundation support system. As one example, if two different types of modular component support brackets, two different types of modular component support plates, two different types of modular component end shafts 424 including different ends or tips, and two different types of helical auger configurations are provided in the end shafts as or as separate modular components, 16 different foundation support assemblies are provided using combinations of such modular components, apart from the various combined shaft lengths made available from modular components having different shaft length as discussed above.

As another example, if three types of each of the four modular components is made available, 81 different foundation support systems may be assembled from the various combinations of components, apart from the various combined shaft lengths made available from the modular components having different shaft length. Therefore, by providing a relatively small set of modular components of each type, a large number of foundation support systems can be assembled and installed to meet a spectrum of needs presented to installers in different locations to meet the needs of a great variety of installation sites and specific foundations for varying building sites. As such, modular foundation systems can be more or less universally used to meet the needs of any job that an installer may expect to encounter.

In contemplated embodiments, the modular components including the couplers described could be provided as kits to be assembled on-site by an installer, with each kit including the components needed to install a particular type of foundation support system. In other embodiments, a set of modular components may be provided to the installer that can be used to construct different types of modular systems, with the installer selecting a desired combination of modular components to construct a foundation support system meeting particular needs for particular job sites and/or different projects at the same or different sites. As such, instead of specific kits of component parts a distributor may obtain a number of each modular component desired and selectively mix and match the modular components to assemble an appropriate modular support system for a specific site from the modular components already at hand.

FIGS. 14-19 are various views of another embodiment of an inner coupler 460 for a modular foundation support piling assembly (sometimes referred to as a modular foundation support pier assembly) of the present invention. The inner coupler 460 may be used in lieu of the coupler 202 to assemble a modular foundation support system of the type described above.

The inner coupler 460 is similar in aspects to the inner coupler 202 as described above but includes four elongated, axially extending ribs 462 projecting outwardly from a round body 464 rather than two. The inner coupler 460 likewise includes a seating surface 466 to complete a coupled connection to a mating coupler such as the outer coupler 500 described below, and a collar portion 468 including a counter bore 470 configured to receive a distal end of a shaft such as the shaft 400, end shaft 424, a bracket shaft, a support plate shaft, or any other shaft or modular component described herein to facilitate assembly of modular foundation support systems.

Figure 14:
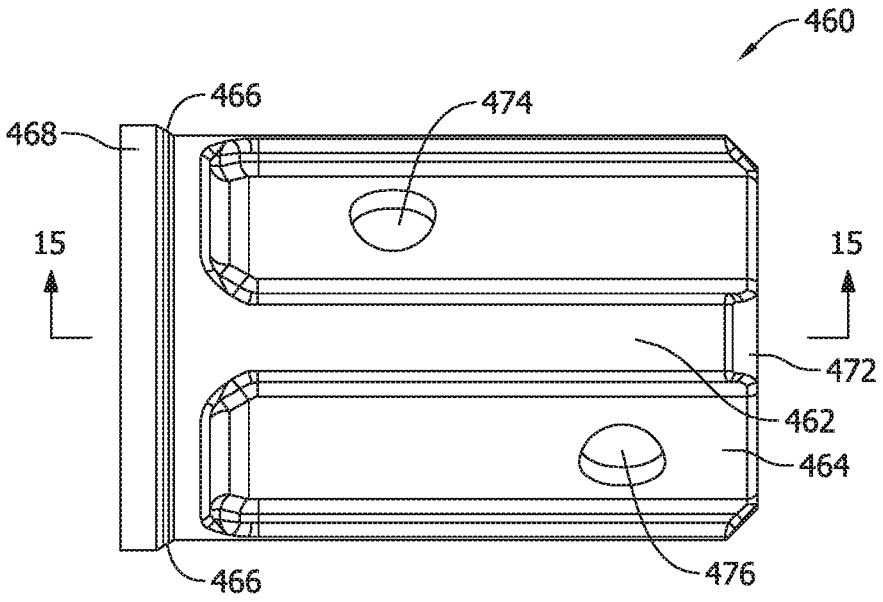
FIG. 14 illustrates a first side view of another exemplary embodiment of an inner coupler for a modular foundation support piling assembly of the present invention.
Figure 15:
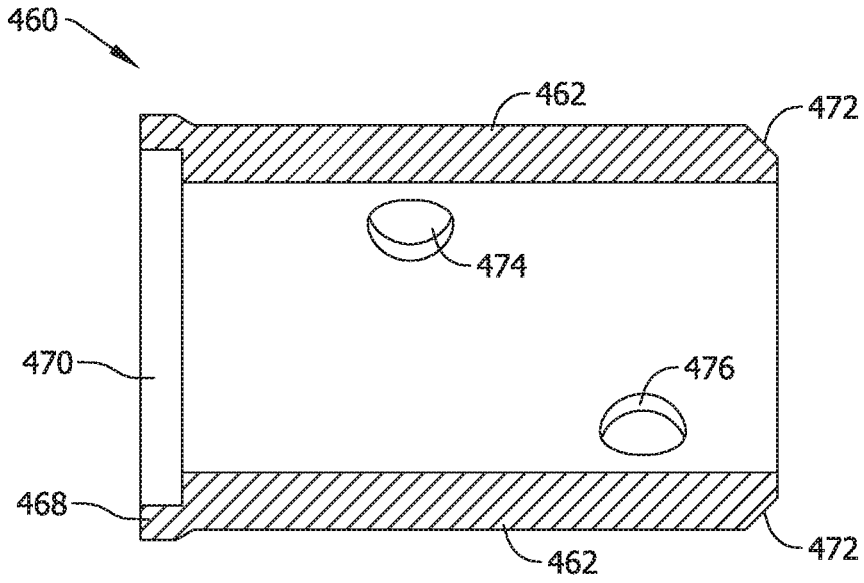
FIG. 15 illustrates a cross-sectional view of the inner coupler taken along line 15-15 in FIG. 14.
Figure 17:
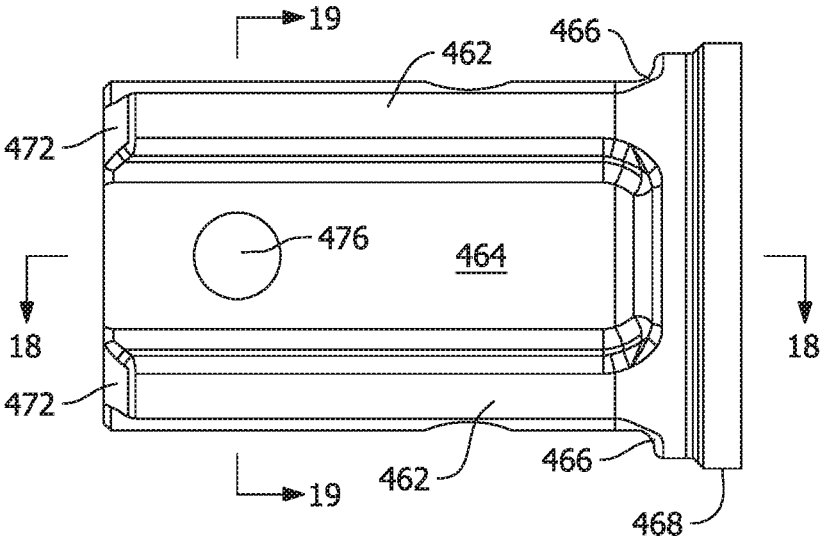
FIG. 17 illustrates a second side view of the inner coupler shown in FIGS. 14-16.
Figure 18:
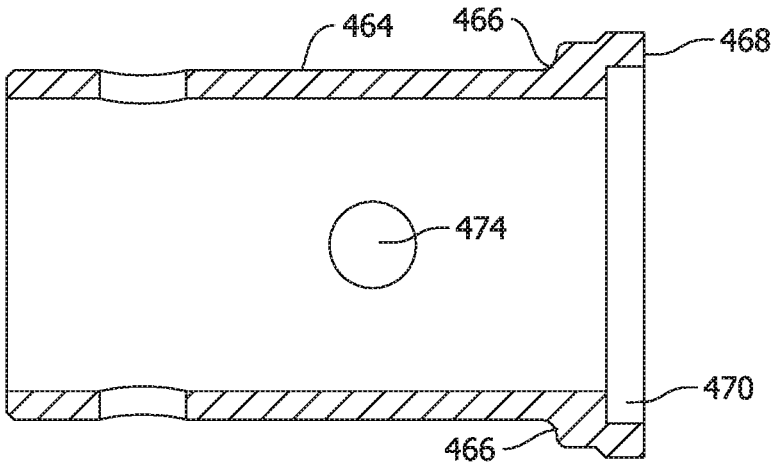
FIG. 18 illustrates a cross-sectional view of the inner coupler taken along line 18-18 in FIG. 17.

Each of the four axially extending ribs 462 in the inner coupler 460 extend from and between the seating surface 466 to a seating surface 472 on the distal end of each rib 462 which extends obliquely from the round body 464 to define an inwardly tapered distal end at the location of each rib 462. The ribs 462 are evenly spaced around the circumference of the round body 464 at 90° center positions from one another. The ribs 462 extend outwardly from the round outer surface of the body 464 at an increased radius relative to the body 464 such that the ribs 462 project outwardly from the body 464. As seen in FIGS. 14 and 17, the ribs 462 are elongated in the longitudinal, axial length direction and relatively narrow in the lateral, width direction. Further, each rib 462 has a constant or uniform width in the lateral direction.

Figure 16:
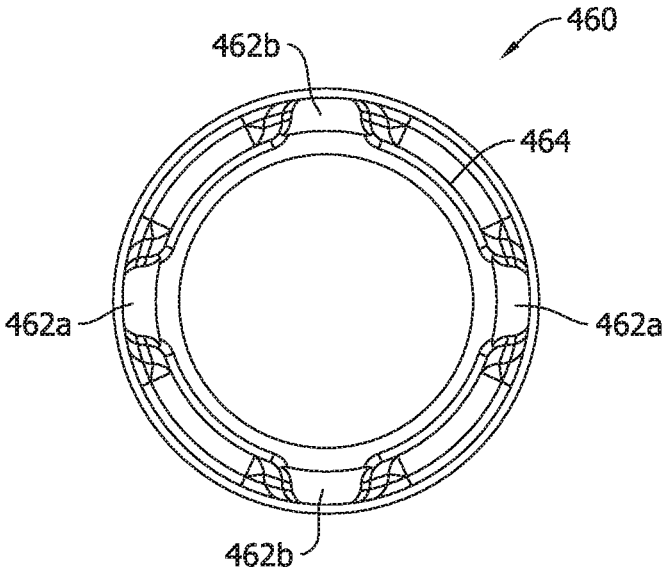
FIG. 16 illustrates a bottom view of the inner coupler shown in FIG. 11.
Figure 19:
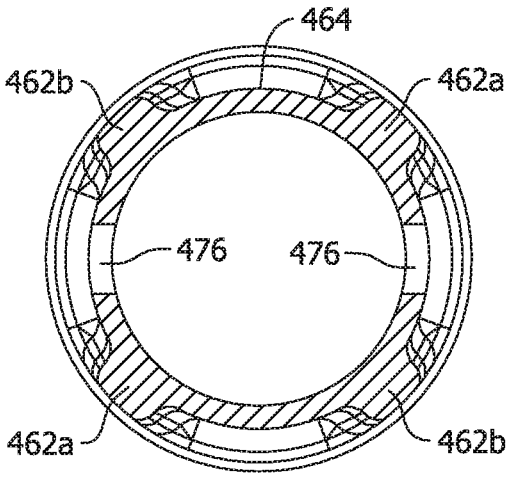
FIG. 19 illustrates a cross sectional view of the inner coupler taken along line 19-19 in FIG. 17.
Figure 20:
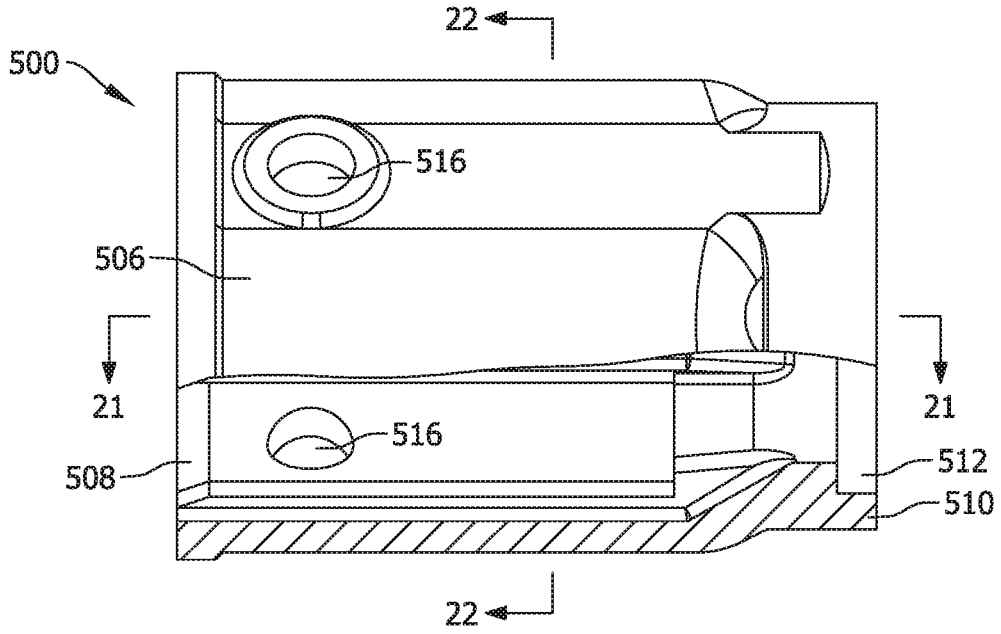
FIG. 20 illustrates a partial side view of an exemplary embodiment of an outer coupler for completing a modular piling assembly in combination with the inner coupler shown in FIGS. 14-19.
Figure 21:
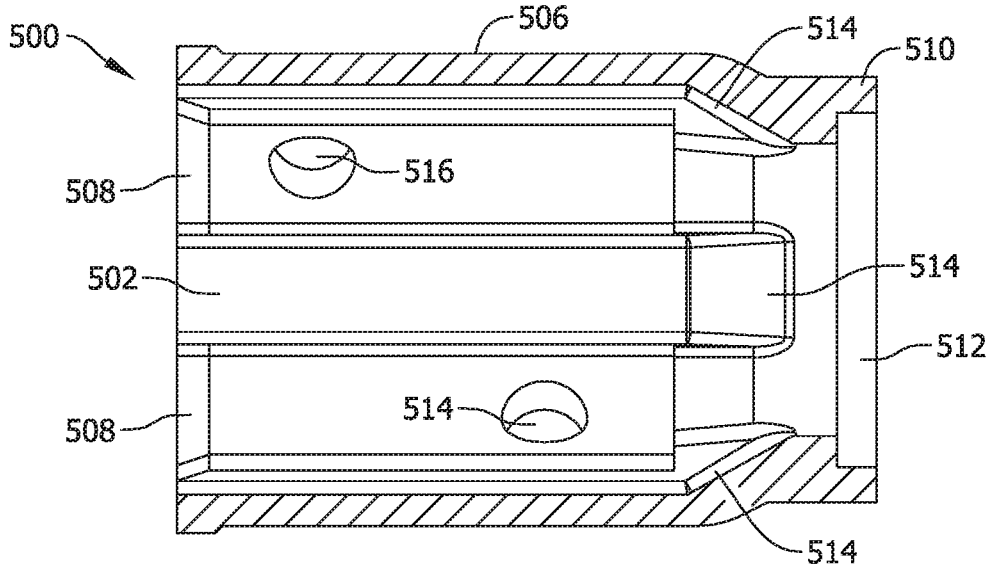
FIG. 21 illustrates a first cross-sectional view of the outer coupler taken along line 21-21 in FIG. 20.

As best shown in FIGS. 16 and 19, however, the ribs 462 in the example shown do not have the same width relative to one another. Specifically, the ribs 462 include a first pair of ribs 462*a* oppositely positioned from one another at about 180° positions on the round body 464. A second pair of ribs 462*b* is also oppositely positioned from one another at about 180° positions from one another on the round body 464, but the pair of ribs 462*b* are offset 90° in position with respect to the first pair of ribs 462*a*. The first pair of ribs 462*a* is proportionally larger than the second pair of ribs 462*b* in terms of occupying a greater portion of the circumference of the body 464 in the width dimension. In other words, the ribs 462*a* are wider on the arcuate circumference of the body 464 than the ribs 462*b*, while being the same axial length as the ribs 462*b*. The wider ribs 462*a*, in combination with the relatively smaller width ribs 462*b* effectively serve as primary and secondary torque transmission features as well as primary and secondary alignment features when mated with a complementary coupler described below. In another contemplated embodiment, however, the ribs 462*a* and 462*b* may the same width rather than different.

The body 464 of the inner coupler 460 also includes, as shown in the Figures, one or more pairs of fastener holes or openings 474, 476 defined therethrough to allow for fastening of the inner coupler 460 and a complementary outer coupler 500 described below. Each of the pairs of fastener holes or openings 474, 476 is angularly offset and axially offset from one another and are further spaced from the ribs 462 on the body 464 in the example shown. That is, the fastener openings 474, 476 are respectively located between respective ones of the ribs 462*a* and 462*b* on the body 464. In the specific example shown, the ribs 462*a*, 462*b* are respectively located at 0°, 90°, 180°, and 270° positions on the circumference of the body 464 as seen in FIGS. 16 and 19, whereas the fastener openings 474, 476 are located at 45°, 135°, 225° and 315° positions on the body 464. As such, the fastener holes 474, 476 extend through the relatively thin portion of the outer body 464 instead of through the thicker portions where the ribs 462*a*, 462*b* extend.

In alternative embodiments, one or both of the fastener holes 474, 476 could be considered optional and may be omitted as fasteners are not necessarily required to complete interlocking connections of the modular components described. Additional, and to the extent that fastener holes are desired, such fastener holes could be provided at locations other than those specifically shown and described above in the illustrated embodiment of FIGS. 14-19.

FIGS. 20-26 are various views of an exemplary embodiment of an outer coupler 500 for completing a modular foundation support pier assembly in combination with the inner coupler 462 shown in FIGS. 14-19. The outer coupler 500 may be used in lieu of the outer coupler 204 to assemble a modular foundation support system.

The outer coupler 500 includes four axially extending grooves 502 that are formed in a round inner surface 504 of a body 506. The body 506 is formed with a seating surface 508 on a distal end thereof. Opposite the seating surface 508, the outer coupler 500 includes a flange 510 defining a cavity 512 that receives a distal end of a shaft such as the shaft 400, end shaft 424, a bracket shaft, a support plate shaft, or any other shaft or modular component described herein to facilitate assembly of modular foundation support systems. The outer coupler 500 may be mated with any modular component that includes the inner coupler 460 or the alignment features of the inner coupler 460.

Each of the four axially extending grooves 502 extends from and between the seating surface 508 to a seating surface 514 on which extends obliquely from round body 464. The axially extending grooves 502 are spaced around the circumference of the round body 506 at 90° positions from one another as shown.

Figure 22:
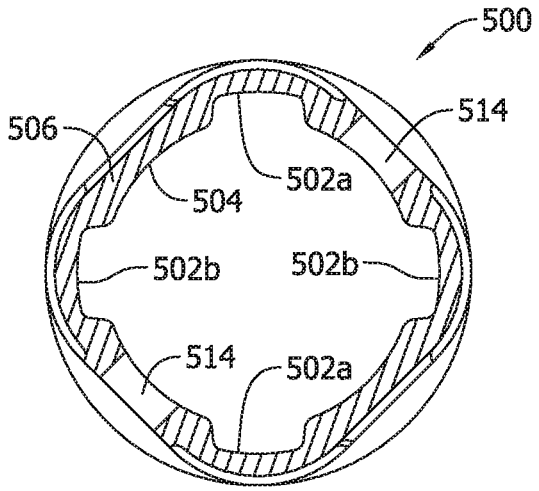
FIG. 22 illustrates a second cross-sectional view of the outer coupler taken along line 22-22 in FIG. 20.
Figure 23:
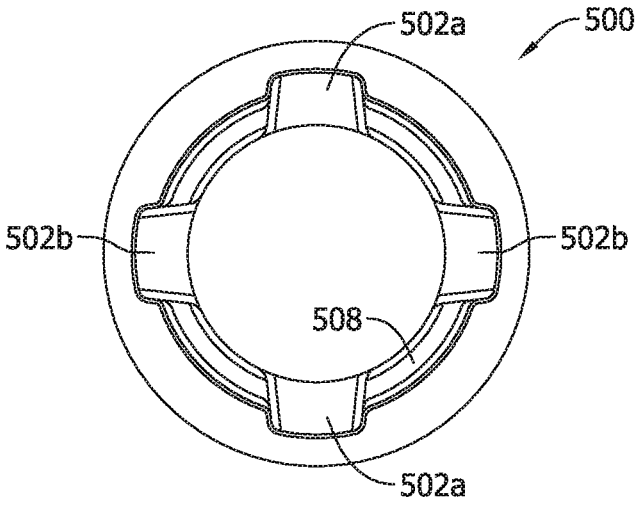
Figure 24:
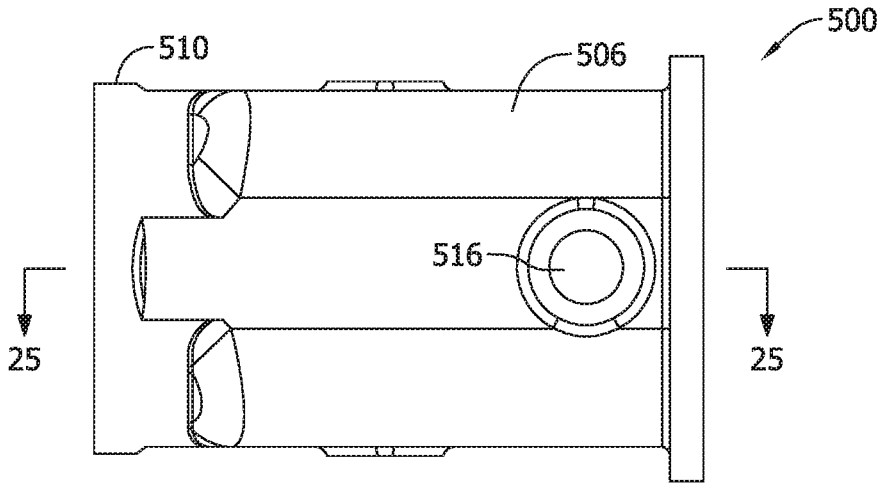
FIG. 24 illustrates a second side view of the outer coupler shown in FIGS. 20-23.
Figure 25:
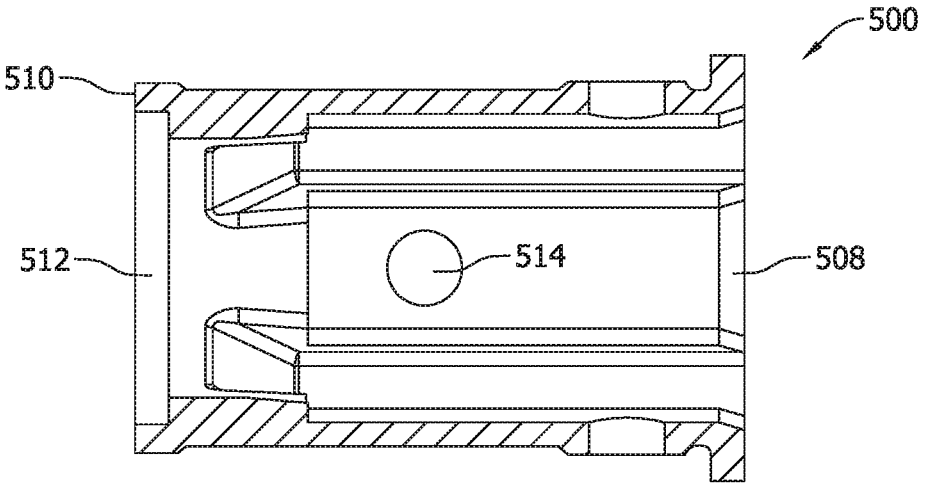
FIG. 25 illustrates a cross-sectional view of the outer coupler taken along line 25-25 in FIG. 21.
Figure 26:
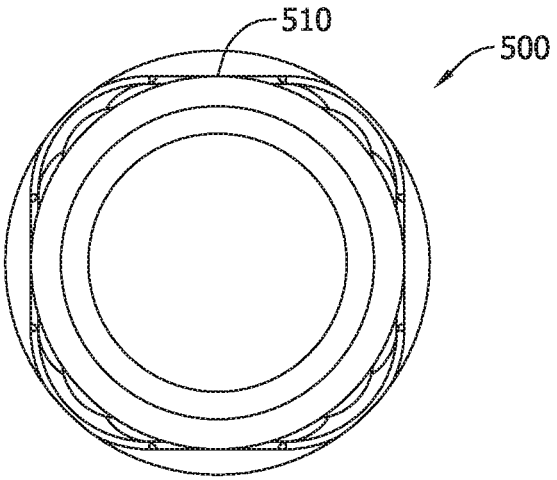
FIG. 26 illustrates a bottom view of the outer coupler shown in FIG. 24.
Figure 27:
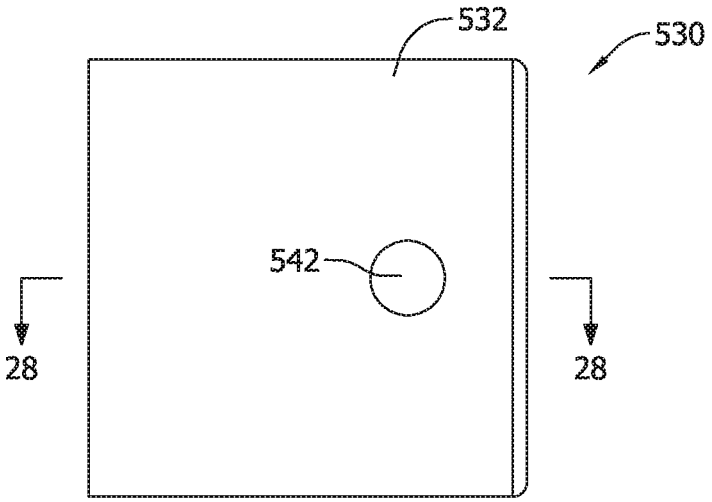
FIG. 27 is a side view of an exemplary embodiment of a drive tool coupler for a modular foundation support piling including the inner coupler shown in shown in FIGS. 14-19.
Figure 28:
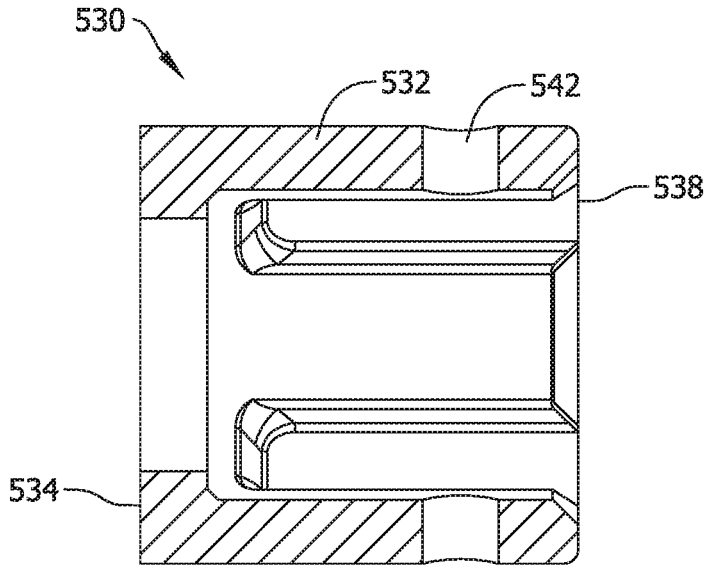
FIG. 28 is a cross-sectional view of the drive tool coupler taken along line 28-28 in FIG. 27.
Figure 29:
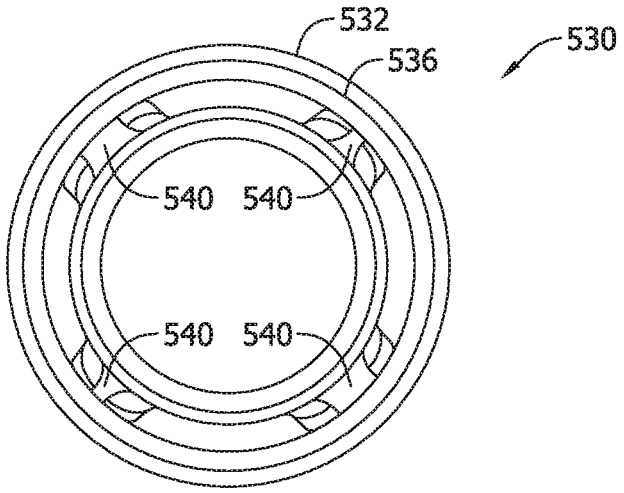
Figure 30:
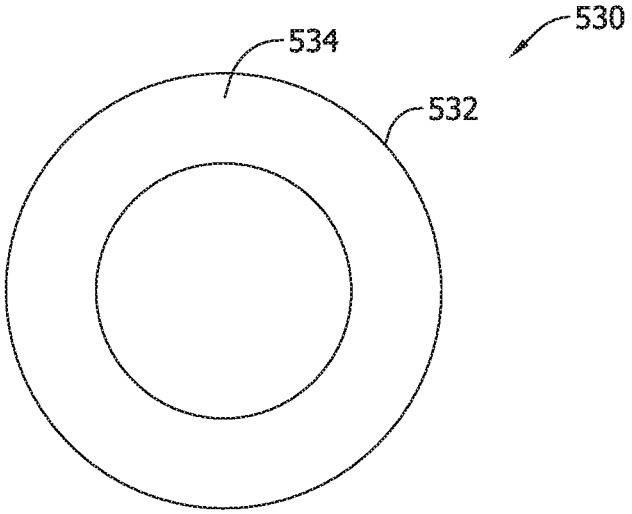
FIG. 30 is a top view of the drive tool coupler shown in FIG. 27.
Figure 31:
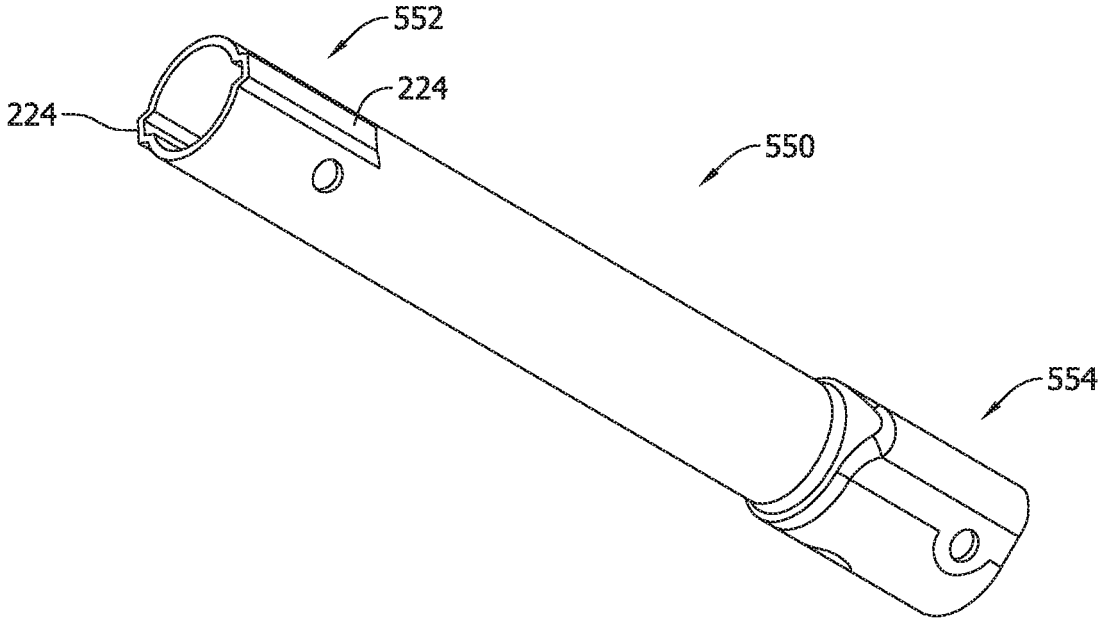
FIG. 31 is a perspective view of another embodiment of a foundation support shaft including an integral inner coupler on one end and an integral outer coupler on the other end.
Figure 32:
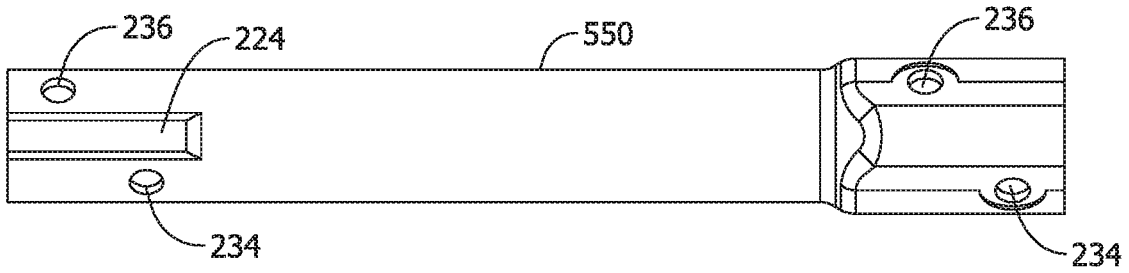
FIG. 32 is a first side view of the shaft shown in FIG. 31.
Figure 33:
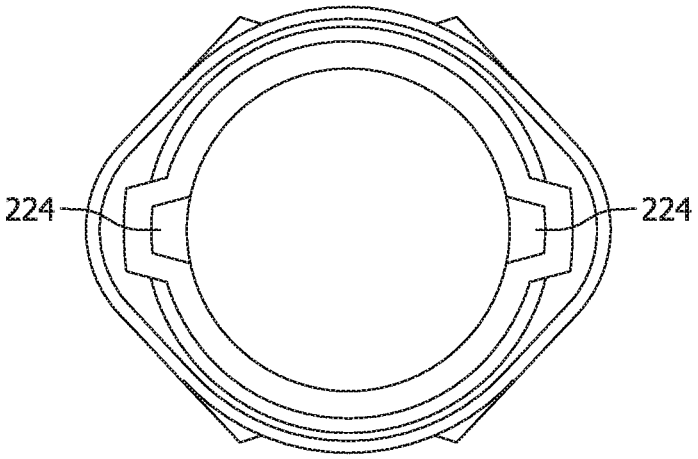
FIG. 33 is a first end view of the shaft shown in FIG. 32.
Figure 34:
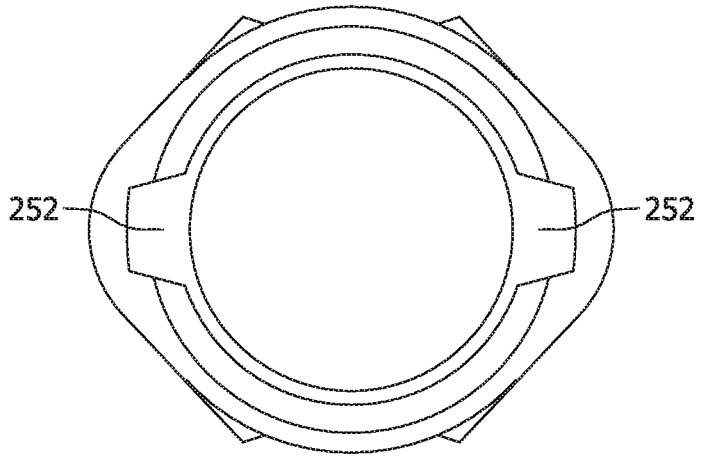
FIG. 34 is a second end view of the shaft shown in FIG. 32.
Figure 35:
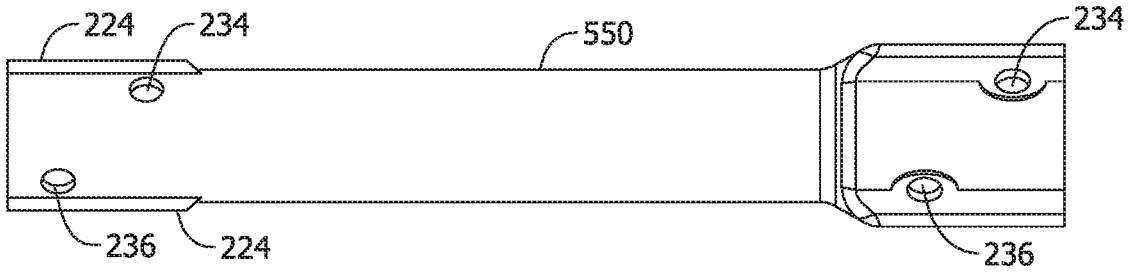
FIG. 35 is a second side view of the shaft shown in FIG. 32.

As best shown in FIGS. 22 and 23, the four axially extending grooves 502 includes a first pair of axially extending grooves 502*a* oppositely positioned from one another on the round body 506 and a second pair of axially extending grooves 502*b* oppositely positioned from one another on the round body 506 but in a 90° position with respect to the first pair of ribs 502*a*. The first pair of axially extending grooves 502*a* is proportionally larger than the second pair of axially extending grooves 502*b* in terms of occupying a greater portion of the circumference of the body 506. In other words, the axially extending grooves 502*a* are wider on the circumference of the body 506 than the axially extending grooves 502*b*. The grooves 502*a*, 502*b* are complementary in shape to the ribs 462*a*, 462*b* of the inner coupler 460 such that the grooves 502*a*, 502*b* are elongated in the longitudinal, axial length direction and relatively narrow in the lateral, width direction. Further, each groove 502 has a constant or uniform width in the lateral direction.

The body 506 of the outer coupler 500 also includes, as shown in the Figures, first and second pairs of fastener holes or openings 514, 516 extend through the body 506 which are angularly offset from one another and axially offset from one another to allow for fastening of the outer coupler 500 and the complementary inner coupler 460 described above. The fastener holes or openings 514, 516 are further spaced from and between the respective grooves 502*a*, 502*b* in respectively similar positions on the body 506 as the corresponding fastener holes in the inner coupler 460. In alternative embodiments, one or both of the fastener holes 514, 516 could be considered optional and may be omitted as fasteners are not necessarily required to complete interlocking connections of the modular components described. Likewise, alternative locations of fasteners holes are possible in other embodiments.

Like the couplers 202, 204 described above, when the distal end of the inner coupler 460 is partly inserted into the distal end of the outer coupler 500 simple rotation of the outer coupler 500 causes automatic alignment of the ribs 462*a*, 462*b* and the grooves 502*a*, 502*b*, and once so aligned, the outer coupler 500 will fall into place in engagement with the inner coupler 460 via gravitational force. Therefore, the ribs 462*a*, 462*b* and the grooves 502*a*, 502*b* serve as a primary and secondary self-alignment features that makes it easier to connect shafts to one another other in a modular foundation support system assembly. When the ribs 462*a*, 462*b* and grooves 502*a*, 502 are mated, a complete torque transmitting interlocking engagement of the couplers 460, 502 is established, and the fastener holes in each coupler are self-aligning with one another to quickly and easily secure the couplers 460, 500 to one another with bolts in a cross-bolt arrangement.

Because the couplers 460, 500 include the respective pairs of ribs 462*a*, 462*b* and pairs of grooves 502*a*, 502*b* instead of one pair of ribs and grooves as in the couplers 202, 204 described above, the couplers 460, 500 have greater structural strength for use with larger foundation support piles or piers that are subject to increased torque and rotational force while being installed. As best seen in FIG. 22, the structural strength needed to withstand greater torque transmission results at least in part in a square shaped outer surface of the body 506 of the outer coupler 500. The square shape also facilities cross-bolt fastener connections with mechanical isolation of the fasteners from torque.

The couplers 460, 500 may be provided on opposing ends of the same modular shaft such as that described above in lieu of the couplers 202, 204 to provide an alternative modular shaft to the shaft 400 described above. For example, the couplers 460, 500 may be integrally provided in the shaft 400 via casting in the fabrication of a shaft 400, swaged on the shaft ends 402, 404 in a forging process, provided on a separate body and welded on the shaft ends 402, 404, or otherwise connected to the shaft 400 in another manner. Other modular foundation components such as the end shaft 424, support bracket 422, support plate 442 or other accessories may be provided with one of the couplers 460, 500 for connection to the modular shaft at its respective ends in a similar manner to that described above in the modular foundation support systems 420 and 440 (FIGS. 12 and 13).

While embodiments of couplers 202, 204 have now been described as having two ribs mating with two grooves and embodiments of couplers 460, 500 are described as having four ribs mating with four grooves, additional embodiments of couplers, or shafts including such coupling features, are possible having other numbers of ribs or grooves. For example only, three ribs and three grooves may be provided in another embodiment for modular assembly. The number of ribs and grooves in such alternative embodiments and the locations of the ribs and grooves may necessitate changes in the number of fastener openings provided and the locations of the fastener openings in such embodiments such that single fastener connections may result or dual fastener connections that are not orthogonal. As noted above, however, fasteners are not necessarily required in all instances, and in some cases fastener holes may be omitted.

FIGS. 27 through 30 are various views of an exemplary embodiment of a drive tool coupler 530 for a modular foundation support piling including the inner coupler 460 shown in shown in FIGS. 14-19. The drive tool coupler 530 includes a coupler body 532 having a drive tool end 534 bad a shaft coupling end 536. The coupling end 538 includes a seating surface 538 in communication with a plurality of axially extending grooves 540 that engage with the ribs 462 of the inner coupler 460 as described above in a rotationally interlocked, torque transmitting arrangement. A pair of fastener openings 542 is provided in the body 532 for positive attachment to a drive tool (not shown) for installing a shaft 400 or 424 in a modular foundation support assembly as described above. The drive tool coupler 530 is compatible with each of the end shaft 424 and the modular shaft extension 400 such that each can be separately attached to the drive tool for driving them into the ground, first the shaft 424 and then the shaft 400 after attachment to the shaft 424 via the coupling features provided.

While the drive tool coupler 530 is complementary to the inner coupler 460 for mating engagement therewith, in another embodiment the drive tool coupler may be adapted to complement the outer coupler from mating engagement therewith by providing the drive tool coupler with ribs instead of grooves. In certain embodiments, more than one drive tool may be made available for use by a foundation support system installer, including but not necessarily limited to a drive tool coupler configured to mate with one of the couplers 202, 204 described above. So long as the drive tool coupler utilized matches the coupler features of the modular component being driven into the ground, the drive tool coupler facilitates drive tool engagement via self-aligning coupling features for quick connection and disconnection of the drive tool coupler to install a modular foundation support system.

FIGS. 31-35 are various views of another embodiment of a foundation support shaft 550 including an integral inner coupler 552 on one end and an integral outer coupler 554 on the other end. The axially extending ribs 224 on the inner coupler 552 and the axially extending grooves 252 on the outer coupler 554 provide for interlocking torque transmission to mating components having complementary coupler features. Pairs of fastener openings 234, 236 are provided to facilitate cross-bolt connections while mechanically isolating the fasteners used. When the ribs 224 and grooves 552 are aligned, which may be accomplished by relative rotation of the ribs 224 with respect to the grooves 552, connected foundation support components may fall into place with fastener openings 234, 236 being aligned to receive the fasteners. The shaft 550 may be filled with cementitious material as described above.

The couplers 552, 554 may be integrally provided in the shaft 550 via casting in the fabrication of a shaft 550, swaged on the shaft ends in a forging process, welded on the shaft ends, or connected to the shaft 500 in another manner. To accommodate increased torque transmission forces, ribs 224 and grooves 252 are proportionally larger on a shaft of increased diameter. The flared, built-up material around the grooves 252 partly encroaches the fastener openings 234, 236 on the corresponding end of the shaft and the fastener openings extending through relatively thicker material on the shaft end than an otherwise similar shaft 550 fabricated for a lesser torque transmission. The shaft 550 may be used in the assembly of modular foundation support systems as described above including mating couplers or component having integral coupling features.

The benefits and advantages of the inventive concepts described herein are now believed to have been amply illustrated in relation to the exemplary embodiments disclosed.

An embodiment of a modular foundation support system has been disclosed including a first foundation support component having a first distal end and a plurality of axially elongated ribs extending from an outer surface of the first distal end, and a first pair of fastener holes extending through the outer surface proximate the first distal end. A second foundation support component is also provided having a second distal end and plurality of spaced apart, axially elongated grooves on an inner surface of the second distal end, and a second pair of fastener holes extending through the inner surface of proximate the second distal end. When the plurality of axially elongated ribs are mated with the plurality of axially extending grooves, the first and second foundation support components are rotationally interlocked with one another and the first and second pair of fastener holes are self-aligning with one another to receive a first fastener therethrough such that the fastener is mechanically isolated from rotational torque transmission.

Optionally, the plurality of ribs may include a first pair of ribs opposing one another on the outer surface. The plurality of ribs may include a second pair of ribs opposing one another on the outer surface between the first pair of ribs. The first pair of ribs may be proportionally larger than the second pair of ribs. Each of the first pair of ribs and the second pair of ribs may include an angled seating surface facilitating self-alignment of the plurality of ribs and the plurality of grooves.

The first foundation support component shaft may include a third pair of fastener openings axially offset and angularly offset from the first pair of fastener openings proximate the first distal end, and the second foundation support component shaft may include a fourth pair of fastener openings axially offset and angularly offset from the second pair of fastener openings proximate the first distal end. When the plurality of axially elongated ribs are mated with the plurality of axially extending grooves, the first and second pair of fastener holes are self-aligning with one another to receive a second fastener therethrough such that the second fastener is mechanically isolated from rotational torque transmission. The first and second fasteners may be received to extend orthogonally to one another.

The first and second foundation support component may each have one of a circular, square, or hexagonal cross-section. One of the first foundation support component and the second foundation support component may be a modular shaft having an axial length extending between opposing distal ends thereof, and each of the opposing distal ends may include either the plurality of axially elongated ribs or the plurality of axially elongated grooves. One of the opposing distal ends of the modular shaft includes the plurality of axially elongated ribs and the other of the opposing distal ends of the modular shaft includes the plurality of axially elongated grooves.

As further optional features, the first pair of fastener openings may be spaced from each of the plurality of axially elongated ribs on the first distal end, and the inner surface of the second distal end may be round and an outer surface of the second distal end is square. Each of the first foundation component and the second foundation component may be a steel shaft, and the plurality of axially elongated ribs or the plurality of axially extending grooves may be cast into the respective steel shaft. The plurality of axially elongated ribs or the plurality of axially extending grooves may alternatively be swaged on the respective steel shaft, or may be coupled to the respective steel shaft via a body welded to the steel shaft.

The first foundation support component may be a steel foundation support pier, and the steel foundation pier may be provided with a helical auger. The second foundation support component may be selected from the group of a modular foundation support pier extension, a foundation support bracket, a foundation support plate, and a drive tool coupler.

The modular foundation support system may also be provided in combination with a drive tool coupler having a complementary coupler feature to each of the first and second foundation support components. The drive tool coupler may include a plurality of axially extending grooves.

Another embodiment of a modular foundation support system has been disclosed including a modular foundation support system having a first modular foundation support component comprising at least one elongated modular shaft selected from a set of modular elongated shafts including shafts of respectively different axial length for constructing a foundation support pier in a selected one of a plurality of foundation support pier lengths to support a building foundation at an installation site. Each of the plurality of modular elongated shafts in the set has opposing distal ends and a plurality of torque transmitting coupler features proximate each of the opposing distal ends. The plurality of torque transmitting coupler features proximate each of the opposing distal ends includes outwardly projecting axially elongated ribs or inwardly depending axially elongated grooves for interlocking torque transmitting engagement with a second modular foundation support component having complementary coupler features.

Optionally, the plurality of axially extended ribs may include at least a pair ribs having a seating surface obliquely extending from the respective distal end of the modular shaft. The plurality of axially extended ribs may also include a first rib and a second rib having proportionally different size. The first rib and the second rib may have a proportionally different circumferential width on the outer surface. The plurality of axially extended ribs may include at least four axially extending ribs.

As further options, the plurality of axially extended grooves may be located between a seating surface obliquely extending from the respective distal end of the modular shaft. The plurality of axially extended grooves may include a first groove and a second groove having proportionally different size. The first groove and the second groove may have a proportionally different circumferential width on the inner surface. The plurality of axially extended grooves may include at least four axially extending grooves.

A first pair of fastener holes may optionally be provided on each of the opposing distal ends of the first modular component, each of the first pair of fastener holes being spaced from each of the coupler features on the respective opposing distal ends. The second modular foundation support component includes a distal end with coupler features complementary to one of the opposed distal ends of the first modular foundation support component, and a second pair of fastener openings spaced from the coupler features in second the modular foundation support component, wherein the first pair of fastener holes in the first modular foundation support are self-aligning with the second pair of fastener holes in the second modular foundation support when the coupler features of the second modular foundation support component are mated to the coupler features of one of the opposing distal ends of the first modular foundation support component, whereby a first fastener may be received in the first and second pair of fastener holes in mechanical isolation from torque transmission by the mated coupler features. Additionally, the first modular foundation support component may optionally include a third pair of fastener holes axially and angularly offset from the first pair of fastener holes on each of the opposing distal ends of the first modular foundation support component, wherein the second modular foundation support component further comprises a fourth pair of fastener holes axially and angularly offset from the second pair of fastener holes, wherein the third pair of fastener holes in the first modular foundation support component are self-aligning with the fourth pair of fastener holes in the second modular support component when the coupler features of the second modular foundation support component are mated to the coupler features of one of the opposing distal ends of the first modular foundation support component, whereby a second fastener may be received in the third and fourth pair of fastener holes in mechanical isolation from torque transmission by the mated coupler features. The first and second fasteners extend orthogonally to one another.

One of the opposing distal ends of the first modular foundation support component may include the plurality of axially elongated ribs and the other one of the opposing distal ends may include the plurality of axially elongated grooves. The coupler features may be cast into at least one of the opposing distal ends of the first modular foundation support component, swaged on at least one of the opposing distal ends of the first modular foundation support component, or separately provided and welded to the distal end.

An embodiment of a coupler assembly for connecting a first modular foundation support component to a second modular foundation support component in a modular foundation support system has also been disclosed. The coupler assembly includes an outer coupler for an end of the first foundation support component, the outer coupler comprising an inner surface formed with at least one pair of axially extending grooves extending between a seating surface extending obliquely on a distal end of the outer coupler, and an inner coupler for an end of the second foundation support component. The inner coupler includes an outer surface formed with at least one pair of axially extending ribs having an obliquely extending seating surface on a distal end on the inner coupler. When the at least one pair of axially extending ribs and the at least one pair of axially extending grooves of the inner coupler and the outer coupler are engaged in a self-aligning manner via the seating surfaces, an interlocking torque transmission structure is established between the end of the first foundation support component and the end of the second foundation support component.

Optionally, the at least one pair of ribs includes a first pair of ribs and a second pair of ribs of proportionally different size than the first pair of ribs. The outer coupler may include a round inner surface and a square outer surface. The first and second modular foundation support components are each selected from the group of a primary support pile, an extension pile, a support plate, and a support bracket. One of the first and second modular foundation support components may include a helical auger.

An embodiment of a modular coupled shaft assembly has also been disclosed including a first modular foundation support component and a second modular foundation support component in a modular foundation support system. The first modular foundation support component and the second modular support component are each selected from a set of otherwise similar modular support components having different predetermined axial lengths. The modular coupled shaft assembly including: an outer coupler for an end of the first modular foundation support component, the outer coupler comprising an inner surface formed with at least one pair of axially extending grooves extending between a seating surface extending obliquely on a distal end of the outer coupler; and an inner coupler for an end of the second modular foundation support component, the inner coupler comprising an outer surface formed with at least one pair of axially extending ribs having an obliquely extending seating surface on a distal end on the inner coupler. When the at least one pair of axially extending ribs and the at least one pair of axially extending grooves of the inner coupler and the outer coupler are engaged in a self-aligning manner via the seating surfaces, an interlocking torque transmission structure is established between the end of the first modular foundation support component and the end of the second modular foundation support component, providing an assembled axial length corresponding to the combined selected length of the first modular support component and the second selected modular support component.

Optionally, the outer coupler may include a round inner surface and a square outer surface. The first and second modular foundation support components may each be selected from the group of a primary support pile and an extension pile. One of the first and second modular foundation support components may include a helical auger. The first modular foundation support component and the second modular foundation support component may be filled with a cementitious material.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A modular foundation support system comprising:

a first modular foundation support component comprising a first steel shaft having a predetermined axial length required to support a building foundation, the first steel shaft having a first distal end with a first outer surface that is at least partially rounded and at least two spaced apart ribs projecting outwardly from the first outer surface; and a second modular foundation support component comprising a second steel shaft having a predetermined axial length required to support the building foundation in combination with the first modular support foundation component, the second steel shaft having a second distal end with a second inner surface that is at least partially rounded, and at least two spaced apart grooves depending inwardly from the second inner surface;

wherein when the first outer surface is inserted into the second inner surface the at least two ribs are received in the at least two grooves to establish a rotationally interlocked mechanical connection between the first and second foundation support components while the first and second foundation support components are being driven into the ground proximate the building foundation with a predetermined coupled shaft length.

2. The modular foundation support system in accordance with claim 1, further comprising a first fastener hole formed in the first distal end and a second fastener hole formed in the second distal end, wherein when the at least two ribs are mated with the at least two grooves, the first and second fastener holes are self-aligning with one another to receive a first fastener therethrough.

3. The modular foundation support system in accordance with claim 2, wherein the first fastener is mechanically isolated from rotational torque transmission by the interlocked at least two ribs and at least two grooves.

4. The modular foundation support system in accordance with claim 1, wherein at least three ribs extend from the first outer surface.

5. The modular foundation support system in accordance with claim 4, wherein the at least three ribs includes at least one rib that is proportionally larger than another one of the at least three ribs.

6. The modular foundation support system in accordance with claim 1, wherein the first modular foundation support component or the second modular foundation support component has a circular, square, or hexagonal cross-section.

7. The modular foundation support system in accordance with claim 6, wherein the at least two ribs and at least two grooves are formed integrally on the respective first and second distal ends.

8. The modular foundation support system of claim 7, wherein at least two ribs and at least two grooves are cast into the respective first steel shaft and second steel shaft.

9. The modular foundation support system of claim 7, wherein the at least two ribs and at least two grooves are swaged on the respective first steel shaft and second steel shaft.

10. The modular foundation support system of claim 1, wherein the at least two ribs and at least two grooves are coupled to the respective first steel shaft and second steel shaft.

11. The modular foundation support system of claim 1, wherein at least one of the first steel shaft and second steel shaft includes at least one rib on a first distal end thereof and at least one groove on a second distal end thereof.

12. The modular foundation support system of claim 1, wherein the first steel shaft is provided with a helical auger.

13. The modular foundation support system of claim 12, wherein the second steel shaft is a modular foundation support pier extension.

14. The modular foundation support system of claim 12 further comprising a foundation support bracket, a foundation support plate, or a drive tool coupler.

15. The modular foundation support system in accordance with claim 1, wherein the at least two spaced apart ribs extend as linear ribs or as curved spiral ribs.

16. A modular foundation support system comprising:

a predetermined set of elongated modular steel shafts having respectively different and predetermined axial lengths for selective assembly thereof to define a foundation support pier in one of a plurality of different predefined coupled shaft lengths to support building foundations at different installation sites having unique needs or different soil conditions, wherein the plurality of different predefined coupled shaft lengths are interchangeably assembled from the predetermined set of elongated modular steel shafts without requiring custom fabrication of a steel shaft having a unique length for a particular installation site;

wherein the predetermined set of elongated modular steel shafts includes at least one modular steel shaft with opposing distal ends and a plurality of torque transmitting coupler features proximate a least one of the opposing distal ends;

wherein at least some of the plurality of torque transmitting coupler features are swaged on the at least one modular steel shaft;

wherein the plurality of torque transmitting coupler features includes outwardly projecting axially elongated ribs or inwardly depending axially elongated grooves respectively extending from a rounded surface; and wherein a mated engagement of the plurality of torque transmitting coupler features of selected ones of the predetermined set of elongated modular steel shafts realizes one of the plurality of different predefined coupled shaft lengths to support a building foundation when driven into the ground proximate the building foundation.

17. The modular foundation support system in accordance with claim 16, wherein the outwardly projecting axially elongated ribs includes at least three outwardly projecting axially elongated ribs.

18. The modular foundation support system in accordance with claim 16, wherein the predetermined set of elongated modular steel shafts includes at least one modular steel shaft having both the outwardly projecting axially elongated ribs and the inwardly depending axially elongated grooves on respective distal ends thereof.

19. The modular foundation support system in accordance with claim 16, wherein the predetermined set of elongated modular steel shafts includes at least one modular steel shaft having a helical auger.

20. The modular foundation support system in accordance with claim 16, wherein the outwardly projecting axially elongated ribs are linear ribs or curved spiral ribs.

21. A coupled shaft assembly for a foundation support system comprising:

a first foundation support shaft including an outer coupler portion having an inner opening and an inner surface formed with a plurality of axially extending non-rounded torque transmitting edges;

a second foundation support shaft including an inner coupler portion having an outer surface formed with a plurality of axially extending non-rounded torque transmitting edges;

wherein when the outer surface of the inner coupler portion is received through the inner opening and engaged to the inner surface of the outer coupler portion, an interlocking torque transmission structure is established between the plurality of axially extending non-rounded torque transmitting edges of the outer coupler portion and the inner coupler portion; and wherein the plurality of axially extending non-rounded torque transmitting edges are defined by a non-uniform wall thickness in the outer coupler portion and the inner coupler portion.

22. The coupled shaft assembly of claim 21, wherein the plurality of axially extending non-rounded torque transmitting edges are further defined by at least one rib or at least one groove in the outer coupler portion or the inner coupler portion.

23. The coupled shaft assembly of claim 21, wherein the outer and inner coupler portion are each configured to receive a distal end of the respective first foundation support shaft and the second foundation support shaft.

24. The coupled shaft assembly of claim 21, wherein the outer and inner coupler portion each include a pair of fastener openings that align with one another to receive a first fastener via the pairs of fastener openings, and wherein the first fastener is mechanically isolated from torsional force via the plurality of axially extending non-rounded torque transmitting edges.

25. A modular foundation support system, comprising:

a first modular foundation support component comprising a first steel shaft being integrally formed with a first coupler portion that is shaped with a first outer surface defining a first plurality of outwardly extending torque transmission engagement surfaces; and a second modular foundation support component comprising a second steel shaft being integrally formed with a second coupler portion that is shaped with a second inner surface defining a second plurality of inwardly extending torque transmission engagement surfaces;

wherein when the first outer surface is inserted into the second inner surface the at least first and second plurality of torque transmission engagement surfaces establish a rotationally interlocked mechanical connection between the first and second modular foundation support components while the first and second modular foundation support components are being driven into the ground proximate the building foundation with a predetermined coupled shaft length.

26. The modular foundation support system in accordance with claim 25, wherein each of the first and second coupler portions has a round cross section, a square cross section, or a hexagonal cross section.

27. The modular foundation support system in accordance with claim 25, wherein at least one of the first and second coupler portions are swaged on respective ends of the first and second modular foundation support components.

28. The modular foundation support system in accordance with claim 25, wherein the first and second torque transmitting surfaces are respectively defined by a rib and a groove.

29. The modular foundation support system in accordance with claim 28, wherein the rib and groove each extend linearly or spirally.

* * * * *